United States Patent [19]

Okumura

[11] 4,302,999

[45] Dec. 1, 1981

[54] ELECTRONIC MUSICAL INSTRUMENT

[75] Inventor: Takatoshi Okumura, Hamamatsu, Japan

[73] Assignee: Nippon Gakki Seizo Kabushiki Kaisha, Hamamatsu, Japan

[21] Appl. No.: 161,222

[22] Filed: Jun. 20, 1980

Related U.S. Application Data

[63] Continuation of Ser. No. 968,860, Dec. 12, 1978, abandoned.

[30] Foreign Application Priority Data

Dec. 14, 1977 [JP] Japan ..... 52-150039

[51] Int. Cl.[3] ..... G10H 5/00; G10H 7/00

[52] U.S. Cl. ..... 84/1.01; 84/1.03

[58] Field of Search ..... 84/1.01, 1.03, 1.24, 84/DIG. 12

[56] References Cited

U.S. PATENT DOCUMENTS

| | | | |
|---|---|---|---|
| 3,610,799 | 10/1971 | Watson | 84/1.01 |
| 3,763,364 | 10/1973 | Deutsch et al. | 84/1.03 X |
| 4,130,043 | 12/1978 | Niimi | 84/1.03 |
| 4,179,972 | 12/1979 | Hiyoshi et al. | 84/1.01 X |

*Primary Examiner*—S. J. Witkowski

*Attorney, Agent, or Firm*—Spensley, Horn, Jubas & Lubitz

[57] ABSTRACT

An electronic musical instrument includes twelve multiplexed wave data generators each of which corresponds to one of twelve musical notes in an octave and produces a multiplexed wave data signal which has a basic pulse frequency decisive of a note and has data indicating states of octavely related plural waves for the same note in a time-division-multiplexed manner. A note selection circuit selects a multiplexed wave data signal for the note designated by the depressed key. The selected wave data signal is converted by a shift register to parallel wave data signals, which are latched by a latch circuit. Selection of the octave is made by the latching time of the latch circuit determining the positions of the bits in the shift register to be latched. Rewriting of latched data in the latch circuit is effected each time the value of the data signal having the highest frequency among the wave data signals varies. The outputs of the latch circuit are used as address signals for reading musical tone waveforms from a waveform memory.

17 Claims, 14 Drawing Figures

TONE GENERATOR (P)
TONE GENERATOR (U)
(ARP)
(L)
(U)
LATCH
DE-CODER
NOTE SELEC-TION
TONE WAVE FORM GENERATION
MULTIPLEXED WAVE DATA GENERATION
DECODER
DATA MULTIPLEXING CIRCUIT
CHANNEL ASSIGNMENT
DEPRESSED KEY DETECTION
KEYBOARD
ACOUSTIC SYSTEM

FIG. 2

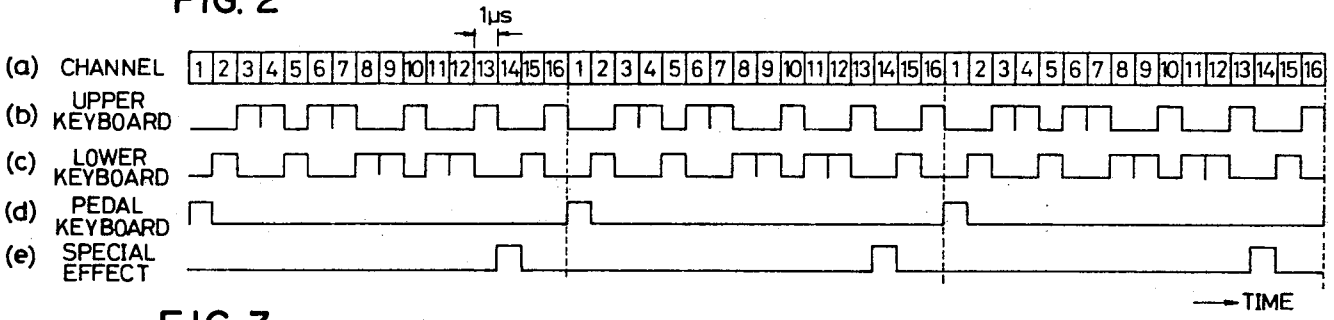

FIG. 3

| TIME SLOT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| $KC_1$ | "1" | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | "1" | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | "1" | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | "1" | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ |
| KEYBOARD | | P | | | U | | | U | | | U | | | U | | | U | | | U | | | U | |
| CHANNEL | | 1 | | | 4 | | | 7 | | | 10 | | | 13 | | | 16 | | | 3 | | | 6 | |

| TIME SLOT | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|---|---|---|---|---|---|
| $KC_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | | $N_4$ |
| KEYBOARD | | L | | | L | | | L | | | L | | | L | | | L | | | L | | | ARP | |
| CHANNEL | | 9 | | | 12 | | | 15 | | | 2 | | | 5 | | | 8 | | | 11 | | | 14 | |

FROM NOTE SELECTION CIRCUIT 29
P.Q2~Q10
31
Φ1Φ2
33
73
SHIFT REGISTER
S1 S2 S3 S4 S5 S6 S7 S8 S9 S10 S11
75
FROM LATCH CIRCUIT 27
OC5 OC3 OC1
OC4 OC2 KO1
83
S
Q
R
Φ1Φ2
Q D
84
85
78
77
76
81
82
79
80
86
90
91
92
87 88 89
SIGNAL PARALLELING CIRCUIT
71
74
SP'
L8 L7 L6 L5 L4 L3 L2 L1
LATCH
97
95
Ra
-5V
r1
r2
r32
-2.5V
r33
r63
98
Rb
96
93
94
J0 K0
L16'
L8'
L4'
(ADDRESS)
72
WAVEFORM MEMORY
0
1
2
31
32
62
63
J1 K1
J2 K2
J31 K31
J32 K32
J62 K62
J63 K63
VDD
99
16' 8' 4'

FROM NOTE SELECTION CIRCUIT 29
P, Q2~Q10
31
(a)
(b)
(c)
Φ1 Φ2
D Q
105
104
SHIFT REGISTER
S1 S2 S3 S4 S5 S6 S7 S8 S9 S10 S11
73
32
FROM LATCH CIRCUIT 27
OC5 OC3 OC1 KO1
OC4 OC2
75
83
S Q
R
84
76
106
85
SIGNAL PARALLELING CIRCUIT
100
LATCH
L8 L7 L6 L5 L4 L3 L2 L1
74
SP'
101
WAVEFORM MEMORY (ADDRESS)
97
-5V
95
r1
r15
r16
-2.5V
r17
r31
98
96
102
103
M16' M8' M4' M2' M1'
0
1
15
16
31
VDD
16' 8' 4' 2' 1'

ELECTRONIC MUSICAL INSTRUMENT

This is a continuation of application Ser. No. 968,860, filed Dec. 12, 1978, and now abandoned.

BACKGROUND OF THE INVENTION

This invention relates to an electronic musical instrument formed according to a system in which tone source signals are provided by reading tone source waveforms in waveform memories, and more particularly to an improvement of the control which is effected in reading tone source waveforms having desired tone pitches in such electronic musical instrument.

DESCRIPTION OF THE PRIOR ART

Conventional control systems for reading waveforms having desired tone pitches out of waveform memories can be roughly divided into two groups. In one of the two groups, a clock pulse having a frequency corresponding to the tone pitch of a note designated by depression of a key in a keyboard is selected, so that a reading address is advanced at a rate corresponding to this clock pulse in the waveform memory. In the other group, a numerical value corresponding to the tone pitch of a note designated by a key is selected out of a numerical value memory, the numerical values thus selected are accumulated at certain time intervals, and the resultant value is used as an address data in the waveform memory.

One example of the former is disclosed by the specification of U.S. Pat. No. 3,515,792 entitled "DIGITAL ORGAN". In this system, a plurality of clock pulses corresponding to the individual keys in one clock pulse-to-one key relation are produced in a parallel mode by a frequency division circuit, and after the clock pulses corresponding to depressed keys have been selected by gates controlled individually by the keys, the clock pulses are supplied to a read control assigner. Therefore, the system is disadvantageous in that the number of lines connecting the frequency division circuit to the key switches and the read control assigner is relatively large and it is necessary to drive the ring counter with the selected clock pulse and to read the waveform memory with the aid of the output of the ring counter thus driven.

One example of the latter is a system disclosed by the specification of U.S. Pat. No. 3,882,751. However, in this system, it is necessary to provide a numerical value memory in which numerical values proportional to musical tone frequencies have been stored in addition to a waveform memory, and to provide a calculation circuit for accumulation of the numerical values.

SUMMARY OF THE INVENTION

OUTLINE OF THE INVENTION

It is therefore an object of this invention to eliminate the above described a disadvantages in the waveform reading systems in the prior art electronic musical instrument.

It is another object of the invention to provide an electronic musical instrument in which the number of wires connecting multiplexed submultiple frequency data generators with a tone generator is remarkably reduced.

According to the present invention, there are provided multiplexed data generator sections, each section corresponding to each note and operating to produce, in a time-division multiplexed fashion, plural frequency data from a pulse having a frequency corresponding to the note. The frequency data thus produced are of octavely-related submultiple frequencies relative to the corresponding note and separate time slots are allotted to the frequency data. Accordingly, each submultiple respective data is timewisely serially produced. One of the plural multiplexed frequency data corresponding to the note of the depressed key is then selected. For utilizing the selected data as an address signal for a waveform memory, the selected data is arranged in parallel by applying it to a series input-parallel output type shift register. The data arranged in parallel is latched by a latch circuit and the latched output is applied to the waveform memory.

BRIEF DESCRIPTION OF THE DRAWINGS

In the accompanying drawings:

FIG. 2 is a timing chart indicating the relations of times assigned in time division manner of tone production channels, which are formed by a tone production circuit shown in FIG. 1;

FIG. 3 is a diagram showing the multiplex states of key codes, etc. produced by a data multiplexing circuit shown in FIG. 1;

FIG. 11(*b*) is a graphical representation showing that a one period waveform of the sine wave (or cosine wave) can be read out by reading the half period waveform in the part (a) of FIG. 11 symmetrically;

Figure 10:
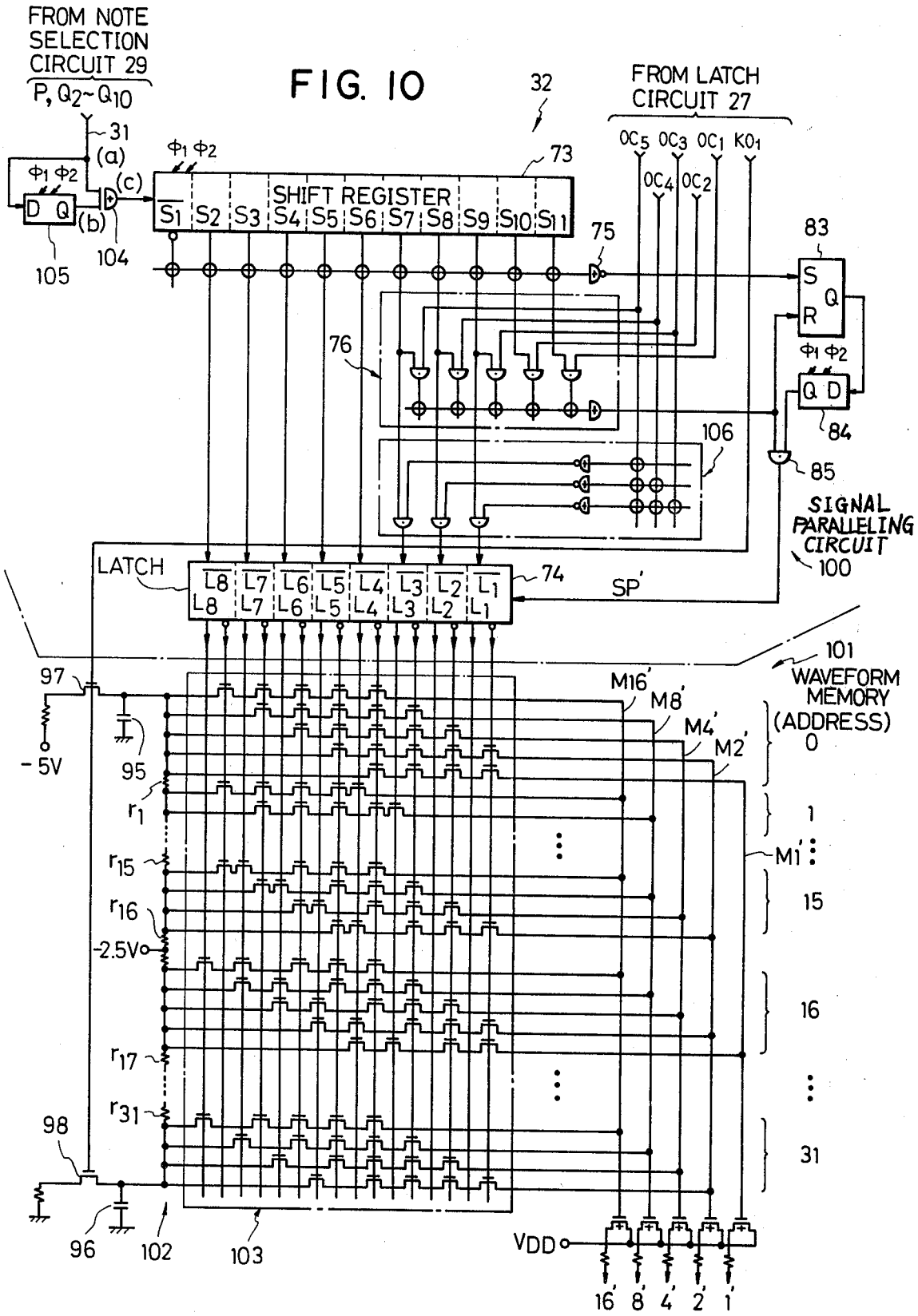
FIG. 10 is a circuit diagram, partly as a block diagram, showing one example of a tone waveform generating circuit adapted to provide sinusoidal waveforms in FIG. 1.
Figure 12:
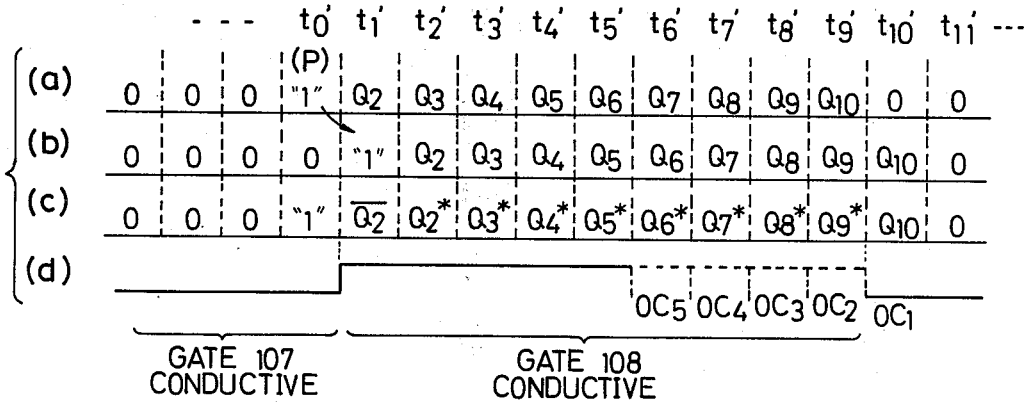
Figure 13:
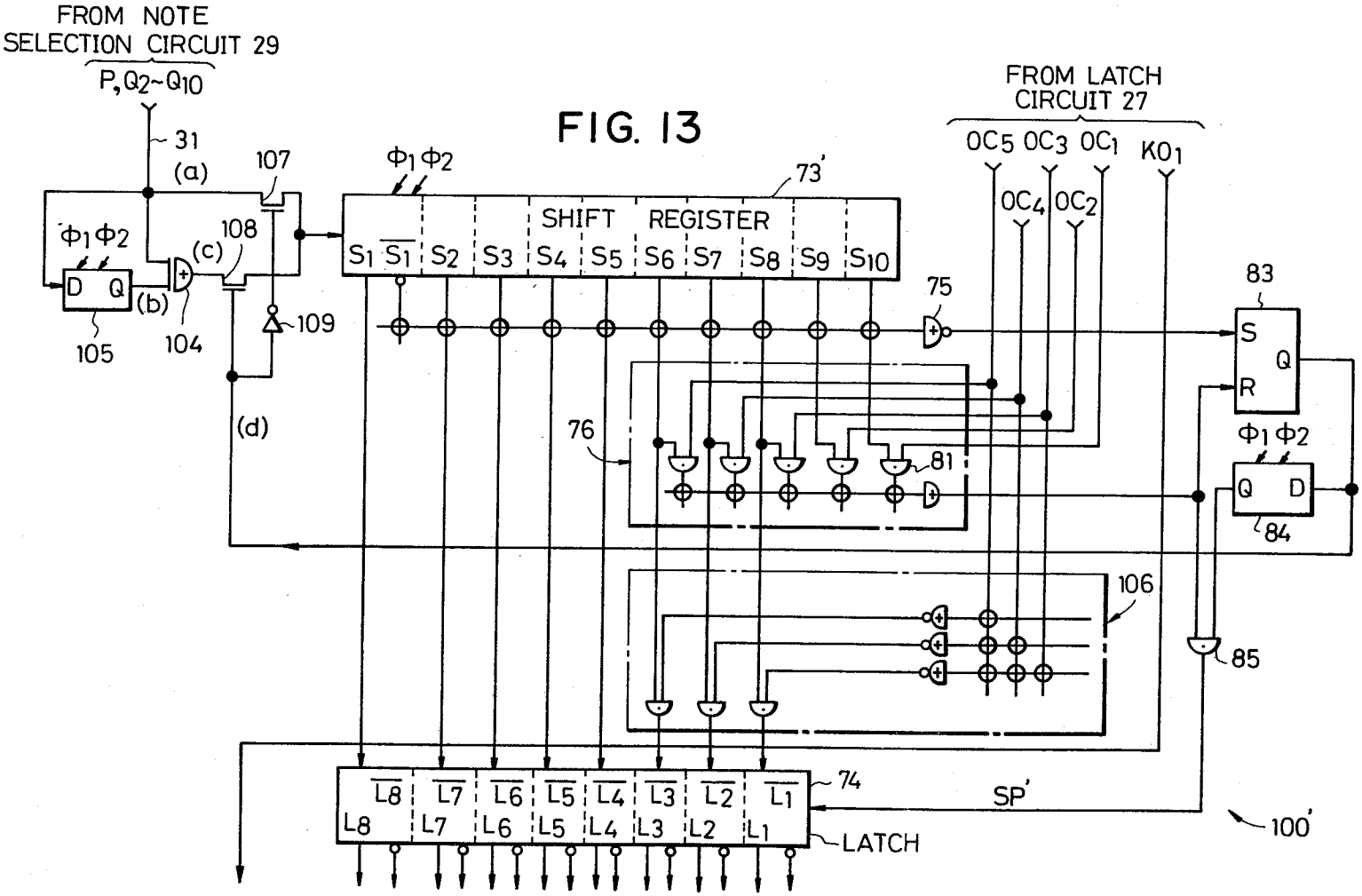

The parts (*a*) through (*c*) of FIG. 12 are timing charts for a description of the operation of a signal paralleling circuit section in FIG. 13 in which binary wave data $Q_2$–$Q_{10}$ are converted into Gray codes;

The part (*d*) of FIG. 12 is a timing chart showing a state of gate switching control signal adapted to input the signal $Q_2$*–$Q_9$* Gray-coded in the signal paralleling circuit in FIG. 13 into a shift register, and FIG. 13 is a circuit diagram, partly as a block diagram, showing one modification of the signal paralleling circuit section in FIG. 10.

Figure 1:
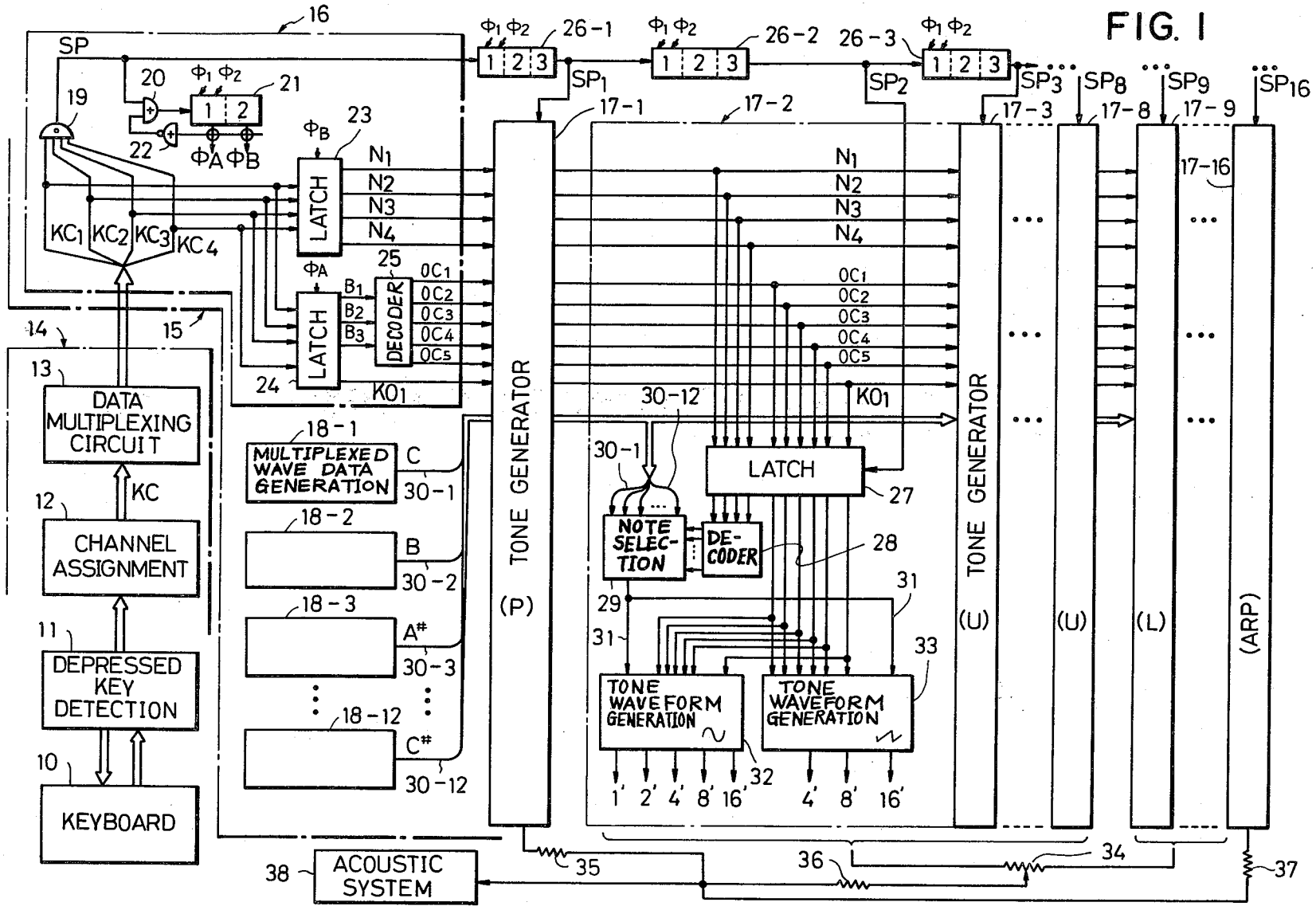
FIG. 1 is a block diagram showing the entire arrangement of one example of an electronic musical instrument according to this invention.

DETAILED DESCRIPTION OF THE INVENTION (1) Description of the Entire Arrangement of One Embodiment Referring to FIG. 1, a keyboard section 10 comprises an upper keyboard, a lower keyboard and a pedal keyboard, and a depressed key detecting circuit 11 operates to detect a key depressed in the keyboard section 10 and to supply information representative of the key thus depressed to a channel assignment circuit 12 which operates to assign the depressed key to one of a particular number of tone production channels. For instance, the number of tone production channels is sixteen (16); more specifically, the number of tone production channels for the upper keyboard is seven, the number of tone production channels for the lower keyboard is also seven, the number of tone production channels for the pedal keyboard is one, and the number of tone production channels for a special effect such as an automatic arpeggio performance effect is one. In the channel assignment circuit 12, the processing times of the tone production channels are formed in time division manner as shown in the part (*a*) of FIG. 2, in which the numerals indicated in the time slots designates the respective channels. The part (*b*) of FIG. 2 shows seven time slots for the upper keyboard exclusive channels; the part (*c*), seven time slots for the lower keyboard exclusive channels; the part (*d*), one time slot for the pedal keyboard exclusive channel; and the pard (*e*), one time slot for the special effect channel. Key codes KC representative of depressed keys, which are assigned to the respective channels, are delivered out in time division manner by the channel assignment circuit 12 in accordance with the channel times shown in the part (*a*) of FIG. 2. Each key code KC consists of a 4-bit note code $N_1$, $N_2$, $N_3$, $N_4$ employed to distinguish 12 notes C through B from one another and a 3-bit block code $B_1$, $B_2$, $B_3$ used to identify an octave range to which a note belongs. Furthermore, the channel assignment circuit 12 outputs in time division manner a 1-bit key-on signal $KO_1$ representing whether a key assigned to a channel is being depressed ("1") or released ("0"), and outputs a variety of control information as required (not described).

The key code KC, the key-on signal $KO_1$ and the control information are applied to a data multiplexing circuit 13, where they are further time divisionally multiplexed into a 4-bit data $KC_1$, $KC_2$, $KC_3$, $KC_4$. This is to reduce the number of connections between an integrated circuit chip 14 including the channel assignment circuit 12 and an integrated circuit chip including a tone generator section 15. In the data multiplexing circuit 13, a reference data used to identify the time slots, i.e. to discriminate what time slot, the key code, etc. of each channel being to is outputted, before the key code, etc. are multiplexed and delivered out. The reference data is such that all of the data bits $KC_1$, $KC_2$, $KC_3$ and $KC_4$ are of the level "1".

There are 48 time slots for the multiplexed data $KC_1$–$KC_4$ which are outputted by the data multiplexing circuit 13. If the time slot in which the reference data "1 1 1 1" is provided is nominated as time slot "1", the arrangement of the data $KC_1$–$KC_4$ in time slots "1" through "48" are as indicated in FIG. 3. In FIG. 3, reference characters U, L, P and ARP designate the channels where the upper keyboard's notes, the lower keyboard's notes, the pedal keyboard's notes and the special effect notes such as automatic arpeggio notes are exclusively assigned, respectively. The numerals in the column "CHANNEL" designate the channels where the key code, etc. $N_1$–$N_4$, $B_1$–$B_3$ and $KO_1$ are assigned. The time slots "1" through "48" occur repeatedly.

The detail of an electronic musical instrument using this data multiplexing circuit 13 is disclosed in the specification of U.S. Pat. No. 4,192,211 filed July 28, 1979 and assigned to the same assignee as the present case; however, it will not be described in detail because it is not the essential matter of the present invention.

The tone generator section 15 comprises: a multiplexed data analyzing circuit 16; sixteen tone generators 17-1 through 17-16 provided in correspondence to the sixteen tone production channels; and multiplexed wave data generator sections 18-1 through 18-12 respectively for the twelve notes constituting an octave. The multiplexed data analyzing section 16 operates to separately pick up the note code consisting of four bits $N_1$–$N_4$, the block code consisting of three bits $B_1$–$B_3$, the key-on signal consisting of one bit $KO_1$ and the remaining control information (not shown) from the data consisting of four bits $KC_1$–$KC_4$ supplied thereto from the data multiplexing circuit 13, and to distribute them to the tone generators 17-1 through 17-16 corresponding to the channels. As is apparent from FIG. 3, three time slots are provided for one channel. If one time slot is one bit time, then the channel for the data $KC_1$–$KC_4$ is changed every three bit times. In FIG. 3, no data are provided for the time slots "4", "7", "10", —, "46" which are first thirds of the respective channels, but these empty time slots are used for transmission of the control information (not shown).

In the multiplexed data analyzing circuit 16, the data $KC_1$, $KC_2$, $KC_3$ and $KC_4$ are applied to a 4-input AND circuit 19, so that the generation timing of the reference data "1 1 1 1" (the time slot "1" in FIG. 1) is detected by the AND circuit 19. A pulse outputted by the AND circuit 19 in response to this detection will be referred to as "a reference pulse SP".

This reference pulse SP is applied through an OR circuit 20 to a 2-stage/1-bit shift register 21 which is driven by two-phase clock pulses $\phi_1$ and $\phi_2$. The period of the clock pulses $\phi_1$ and $\phi_2$ is equal to one time slot of the multiplexed data $KC_1$–$KC_4$. The output $\phi_A$ of the first stage of the shift register 21 is obtained by delaying the reference pulse SP by one bit time, while the output $\phi_B$ of the second stage of the shift register 21 is obtained by delaying the reference pulse SP by two bit times. The two outputs $\phi_A$ and $\phi_B$ of the shift register 21 are applied through a NOR circuit 22 to the OR circuit 20, thus circulating in the shift register 21. Accordingly, the pulse $\phi_A$ is one which has a period of three bit times and a pulse width of one bit time and which is provided in synchronization with the time slots "2", "5", "8", "11", "14"—"44" and "47", and the pulse $\phi_B$ is one which has a period of three bit times and a pulse width of one bit time and which is provided in synchronization with the times slots "3", "6", "9", "12", "15"—"45" and "48" in FIG. 3.

In the accompanying drawings, it should be noted that a multiple-input type logical circuit element is described in accordance with a method in which one input line is drawn on the input side of the element, and the intersections of the input line and the lines of signals to be inputted to the element are encircled.

The multiplexed data $KC_1$–$KC_4$ are applied to 4-bit latch circuits 23 and 24, respectively. The latch circuit 23 is to latch the note code $N_1$–$N_4$, using the pulse $\phi_B$ as its strobe pulse. The latch circuit 24 is to latch the block code $B_1$–$B_3$ and the key-on signal $KO_1$, using the pulse $\phi_A$ as its strobe pulse. As is clear from FIG. 3, the timing of the pulse $\phi_B$ coincides with that of the note code $N_1$–$N_4$, and the timing of the pulse $\phi_A$ coincides with that of the block code $B_1$–$B_3$ and key-on signal $KO_1$. Thus, the latch circuits 23 and 24 can latch the respective data. The contents of data thus latched are respectively rewritten every three bit times in response to the respective pulses $\phi_A$ and $\phi_B$.

Accordingly, the note codes $N_1$–$N_4$, block codes $B_1$–$B_3$ and key-on signals $KO_1$ of the notes assigned to the channels are outputted, in time division manner, with a three-bit-time width by the latch circuits 23 and 24. The order of the channels in this case is as the pedal keyboard exclusive channel "1", the upper keyboard exclusive channels "4", "7", —, "6", the lower keyboard exclusive channels "9", "12" —, "11", and the special effect exclusive channel "14". The block code $B_1$–$B_3$ outputted by the latch circuit 24 is applied to a decoder 25, where it is decoded into an octave signal $OC_1$–$OC_5$ (individual signal appearing one at a time) representative of its octave range. For instance, the octave signal $OC_1$ specifies the lowest octave (or the first octave); the octave signal $OC_2$, the second octave; the octave signal $OC_3$, the third octave, the octave signal $OC_4$, the fourth octave; and the octave signal $OC_5$, the fifth (the highest) octave.

The note code $N_1$–$N_4$ outputted by the latch circuit 23, and the octave signals $OC_1$ through $OC_5$ (through the decoder 25) and key-on signal $KO_1$ outputted by the latch circuit 24 are applied to the tone generators 17-1 through 17-16, and in this case they are distributed to the tone generators 17-1 through 17-16 corresponding to the respective channels in response to the reference pulse SP, and its delayed pulses $SP_1$, $SP_2$, —, $SP_{16}$.

The reference pulse SP is successively delayed by 3-stage shift registers 26-1 through 26-16. Accordingly, pulses $SP_1$, $SP_2$, $SP_3$, —, $SP_{16}$, which are obtained by successively delaying the reference pulse SP by three bit times, are provided by the third stages of these shift registers 26-1 through 26-16 respectively. The timing of these pulses $SP_1$ through $SP_{16}$ corresponds to the time slots "4", "7", "10", —, "46" and "1". The pulses $SP_1$ through $SP_{16}$ are applied to the tone generators 17-1 through 17-16, respectively, so that the note codes $N_1$–$N_4$, octave signals $OC_1$ through $OC_5$ and key-on signals $KO_1$ of the channels supplied in time division manner by the latch circuits 23 and 24 and the decoder 25 are distributed to the tone generators 17-1 through 17-16 of the respective channels. It should be noted that the tone generator 17-1 is for the pedal keyboard exclusive channel (the first channel); the tone generators 17-2 through 17-8, for the upper keyboard exclusive channels (the 4th, 7th, 10th, 13th, 16th, 3rd and 6th channels), respectively; the tone generators 17-9 through 17-15 (not shown); for the lower keyboard exclusive channels (the 9th, 12th, 15th, 2nd, 5th, 8th and 11th channels), respectively; and the tone generator 17-16, for the special effect exclusive channel (the 14th channel).

In FIG. 1, only the tone generator 17-2 is illustrated in detail; however, the remaining tone generators 17-1, 17-3 through 17-16 are similar in arrangement to the tone generator 17-2. Accordingly, typically the tone generator 17-2 will be described.

The note code $N_1$–$N_4$, the octave signals $OC_1$–$OC_5$, and the key-on signal $KO_1$ are applied to the data input of a latch circuit 27. Applied to the strobe input of the latch circuit 27 is the pulse $SP_2$ outputted by the third stage of the shift register 26-2. Accordingly, at the time slot "7" in FIG. 3, the pulse $SP_3$ is outputted, so that the data $N_1$–$N_4$ (from the latch circuit 23), $OC_1$–$OC_5$ and $KO_1$ (both from the latch circuit 24) are inputted into the latch circuit 27. In this operation, the note code $N_1$–$N_4$, block code $B_1$–$B_3$ and key-on signal $KO_1$ of the 4th channel have been positively latched by the latch circuits 23 and 24. Therefore, the note code $N_1$–$N_4$, octave signal $OC_1$–$OC_5$ and key-on signal $KO_1$ of a note assigned to the 4th channel are latched by the latch circuit 27 in the tone generator 17-2 corresponding to the 4th channel. Among the data latched by the latch circuit 27, the note code $N_1$–$N_4$ is applied to a decoder 28, where it is decoded into an output signal representative of an appropriate one out of twelve notes C through B. The output signal of the decoder 28 is applied to the selective control input of a note selecting circuit 29, to the selected signal input side of which the outputs of the multiplexed wave data generator sections 18-1 through 18-12 are applied.

The multiplexed wave data generator sections 18-1 through 18-12 are provided respectively for twelve notes (C through B), each for generating, in a series mode, a plurality of octavely related wave data signal representing octavely related frequencies of one note among the notes (C–B). The frequency of each of the octave indicating bits of the signal thus generated is a function of two's n-th power ($2^n$). Accordingly, the output of any of the multiplexed wave data generator sections (18-1–18-12) is such that a plural-bit binary data is provided in a series mode. A device described in the specification of U.S. Pat. No. 4,228,403, filed June 13, 1978 and assigned to the same assignee as the present case, and entitled "Submultiple-Related-Frequency Wave Generator" may be employed as the multiplexed wave data generator section of this type.

Multiplexed octavely related wave data signals which are outputted respectively by the multiplexed wave data generator sections 18-1 through 18-12 are commonly applied through lines 30-1 through 30-12 to the tone generators 17-1 through 17-12, respectively, so that a single multiplexed wave data signal is selected by the note selecting circuit 27 in each of the tone generators 17-1 through 17-12. For instance, if it is assumed that note C is assigned to the 4th channel, then the note code $N_1$–$N_4$ latched by the latch circuit 27 represents the note C, and the multiplexed wave data on the line 30-1 corresponding to the note C is selected by the note selecting circuit 29 and is introduced to a line 31.

The multiplexed wave data selected by the note selecting circuit 29 is applied through the line 31 to tone waveform generating sections 32 and 33, to which the octave signals $OC_1$–$OC_5$ and the key-on signal $KO_1$ latched by the latch circuit 27 are applied. Each of the tone waveform generating sections 32 and 33 is provided with a waveform memory which has stored predetermined tone waveforms, which are read out in response to the multiplexed wave data supplied thereto through the line 31. The octave signals $OC_1$–$OC_5$ are used to determine the octave range for the tone waveform signal read out of the waveform memory, while the key-on signal $KO_1$ is so utilized that reading the waveform memory is carried out only while a key is depressed. The multiplexed wave data supplied from the line 31 is converted into parallel data in the tone waveform generating sections 32 and 33, which are used as address signals to the waveform memories therein.

The tone waveform generating section 32 is provided with a memory which has stored tone waveforms of flute family tone colors, and flute family waveforms (sine waveforms) having pitches for 1-foot register (1'), 2-foot register (2'), 4-foot register (4'), 8-foot register (8') and 16-foot register (16) are read out in a parallel mode. The tone waveform generating section 33 is provided with a memory which has stored saw tooth waveforms, and saw tooth waveform signals having pitches for 4-foot register (4'), 8-foot register (8') and 16-foot register (16') are read out so as to be used as tone source waveforms of string family tone colors.

The waveform signals of the respective footage registers (1', 2', 4', 8', and 16') generated by the flute family tone waveform generating section 32 are subjected to mixing separately according to the footage registers in the respective keyboards and are passed through the respective tone color selecting variable resistors (not shown), and thereafter the signal of each footage register is subjected to mixing. On the other hand, the saw tooth waveform signals of the respective footage registers (4', 8' and 16') generated by the string family tone waveform generating section 33 are subjected to mixing separately according to the footage registers in the respective keyboards and are passed through the respective tone color filters (not shown) and tone color selecting variable resistors (not shown), and thereafter the signal of each footage register is subjected to mixing. Thereafter, the flute family tone signals and the string family tone signals are subjected to mixing separately according to the keyboards. Furthermore, the upper keyboard's tone signal (obtained by mixing the tone signals outputted by the tone generators 17-2 through 17-8) and the lower keyboard's tone signal (obtained by mixing the musical tone signals provided by the tone generators 17-9 through 17-15) are mixed with each other by means of a balance resistor 34, and are thereafter mixed with the pedal keyboard's tone signal (generated by the tone generator 17-1) and the special effect tone signal (generated by the tone generator 17-16) by means of resistors 35, 36 and 37, as a result of which the resultant signal is produced through a sound system 38.

(II) Detailed Description of Essential Sections (Multiplexed wave data generator Sections)

The multiplexed octavely related wave data generator sections 18-1 through 18-12 are provided for the twelve notes C#, D, D#—B and C, respectively. The multiplexed wave data generator sections 18-1 through 18-12 operate to output successively data representative of the value of the wave data at that time, in a timewisely series mode, whenever at least the value of the wave data of the highest frequency among a plurality octavely related data whose frequencies are in the relation that the frequency corresponding to each of the notes are successively subjected to frequency division (or in an octave relation) is inverted.

As conductive to an understanding of the basic arrangement of the multiplexed octavely related wave data generator sections 18-1 through 18-12, a typical multiplexed wave data generator section 18 will be described in detail with reference to FIG. 4.

The multiplexed wave data generator section 18 can be roughly divided into a digital oscillator section 39 and an octavely related wave data forming section 40. In the digital oscillator section 39, a clock pulse is counted in a desired frequency division factor to provide a reference timing pulse P having a desired frequency. In the octavely related wave data forming section 40, digital data (or sub-octave wave data) concerning a plurality of sub-octave signals which can otherwise be obtained by successively frequency-dividing the reference timing pulse P are formed. The sub-octave wave data rare delivered out through a line 30 timewise-serially.

The digital oscillator section 39 includes a maximum length counter comprising: a 7-stage/1-bit shift register 41 made up of seven delay flip-flops and seven OR circuits cascade-connected; an EXCLUSIVE or circuit made up of an AND circuit 42 and a NOR circuit 43 which receive the data $A_6$ and $A_7$ from the 6th and 7th stages of the shift register 41, and a NOR circuit 44 receiving the outputs of the AND circuit 42 and the NOR circuit 43 and the reference pulse signal P; and a NOR circuit 45 receiving the data $A_1$ through $A_6$ from the 1st through 6th stages of the shift register 41. When the contents of the maximum length counter reaches a preset value, an AND circuit 46 provides its output "1" having a one bit time width. Clock pulses for driving these delay flip-flops are not shown in FIG. 4; however, the delay flip-flops are driven by two-phase clock pulses $\phi_1$ and $\phi_2$ (having a period of 1 $\mu$s, for instance) similarly as in the shift register shown in FIG. 1.

The output "1" of the AND circuit 46, passing through a flip-flop 47, an AND circuit 48 and an OR circuit 49/ or through an AND circuit 50 and the OR circuit 49, is provided as the reference timing signal P. The aforementioned maximum length counter is set in an initial state by the reference pulse signal P applied thereto through a line 51. Accordingly, whenever the reference timing pulse P is applied to the maximum length counter including the shift register 41, the maximum length counter repeats its counting operation starting from its initial state. The modulo number of the maximum length counter, that is, the oscillation interval of the digital oscillation section 39 is determined from the input connection state of the AND circuit 46 and from the control as to whether the output of the AND circuit 46 passed through the flip-flop 47 is used as the reference timing pulse P, or not.

The output data $A_1$ through $A_7$ of the stages of the shift register 41 are applied directly or through inveters to the AND circuit 46. In the case of FIG. 4, the output data $A_1$, $A_2$, $A_5$, $A_6$ and $A_7$ are applied directly to the AND circuit 46, but the outputs data $A_3$ and $A_4$ are applied through the inverters thereto. Accordingly, the contents of the maximum length counter namely, the data $A_1$–$A_7$ of the shift register 41 is "1 1 0 0 1 1 1", the input condition ($A_1.A_2.A_3.A_4.A_5.A_6.A_7$) of the AND circuit 46 is established, as a result of which the AND circuit 46 provides the output "1".

When a signal on a control line 52 is at "1", the AND circuit 48 is enabled, while the AND circuit 50 is disabled, whereby the signal delay by one bit through the delay flip-flop 47 is selected. On the other hand, when the signal on the control line 52 is at "0", the AND circuit 48 is disabled and the AND circuit 50 is enabled, whereby the output of the AND circuit 46 is selected as it is (not being delaying). Accordingly, in the case where the input connection state of the AND circuit 46 is so set as to detect the data contents $A_1$–$A_7$ obtained when N clock pulses (not shown) are applied to (the delay flip-flops of) the shift register 41 after the maximum length counter has been set in its initial state, if the signal on the control line is at "0", the reference timing pulse P is provided at an interval of base-N; and if the signal on the control line is at "1", the reference timing pulse P is provided at an interval of base-(N+1). Thus, the digital oscillation section 39 operates to provide the reference timing pulse P by frequency-dividing the bclock pulse for the delay flip-flops, and the frequency division factor is determined substantially by the input connection state of the AND circuit 46 and is slightly changed according to the signal on the control line 52. The actual oscillation period of the reference timing pulse P obtained by the frequency division is scaled by the period (for instance, approximately 1 μs) of the clock pulse of the delay flip-flops.

The octavely related wave data forming section 40 comprises: a memory register made up of delay flip-flop FF1 through FF7 to perform a series shift operation; a 1-bit adder 53; and a delay flip-flop 54 adapted to delay the carry output Co of the adder 53 by one bit time and to feed back it through an OR circuit 55 and an AND circuit 56 to the carry input Ci. Thus, the octavely related wave data forming section 40 operates to perform a series addition operation. In the octavely-related wave data forming section 40, during its series addition operation, sthe contents of the delay flip-flops FF1 through FF7 are successively serially shifted, and the timing pulse P provided by the shift register 41 is added to the least significant bit (the bit of the delay flip-flop FF1). The control as to whether the series addition operation, that is, the shift operation of the delay flip-flops FF1 through FF7 should be carried out or the memory operation should be carried out, is determined by the output of a set-reset (S-R) type flip-flop 57. When the output of this flip-flop 57 is at "1", a signal on a shift line 58 is set to "1", while a signal on a memory line 59 is set to "0", as a result of which the data stored in the delay flip-flops are shifted in the direction of from the delay flip-flop FF7 to the delay flip-flop FF1. Thus, the output data of the delay flip-flop FF1 corresponding to the least significant bit is added to the reference timing pulse P or to the carry signal of the delay flip-flop 54 in the adder 53, and the resultant data is applied to the delay flip-flop FF7 corresponding to the most significant bit. When the output of the flip-flop 57 is at "0", the signal on the memory line 59 is set to "1", while the signal on the shift line 58 is set to "0", and therefore the data in the delay flip-flops FF1 through FF7 are self-held.

The flip-flop 57 produces a set output "1" for bit times corresponding to the number of stages of the register comprising the delay flip-flops FF1 through FF7. This will be described with reference to FIG. 5. When a single reference timing pulse P is provided by the oscillation section 39 in the time slot $t_1$ as shown in the part (a) of FIG. 5, the flip-flop 57 is set through an OR circuit 60. In this operation, the signal "1" is inputted into the second through seventh stages of the shift register 41 through the line 51, while the signal "0" is inputted into the first stage through the line 51 and the NOR circuit 44. Therefore, in the time slot $t_2$, after one bit time, the data $A_1$–$A_7$ becomes "0 1 1 1 1 1 1" as shown in the part (b) of FIG. 5. As the data is shifted right successively, the data $A_1$–$A_7$ is changed as shown in the part (b) of FIG. 5. Thus, in the time slot $t_8$, after seven bit times, the data $A_7$ of the seventh stage of the shift register 41 is set to "0". This data $A_7$ is inverted by an inverter 61 as shown in the part (c) of FIG. 5, and is applied to the reset input R of hte flip-flop 57. Thus, the slip-flop 57 is set for seven bit times (time slots $t_1$ through $t_7$) after the reference timing pulse P has been raised to "1" as shown in the part (d) of FIG. 5, and therefore produces the set output "1". A signal IC applied to the OR circuit is an initial clear signal which is raised to "1" when the power switch is turned on.

Figure 5:
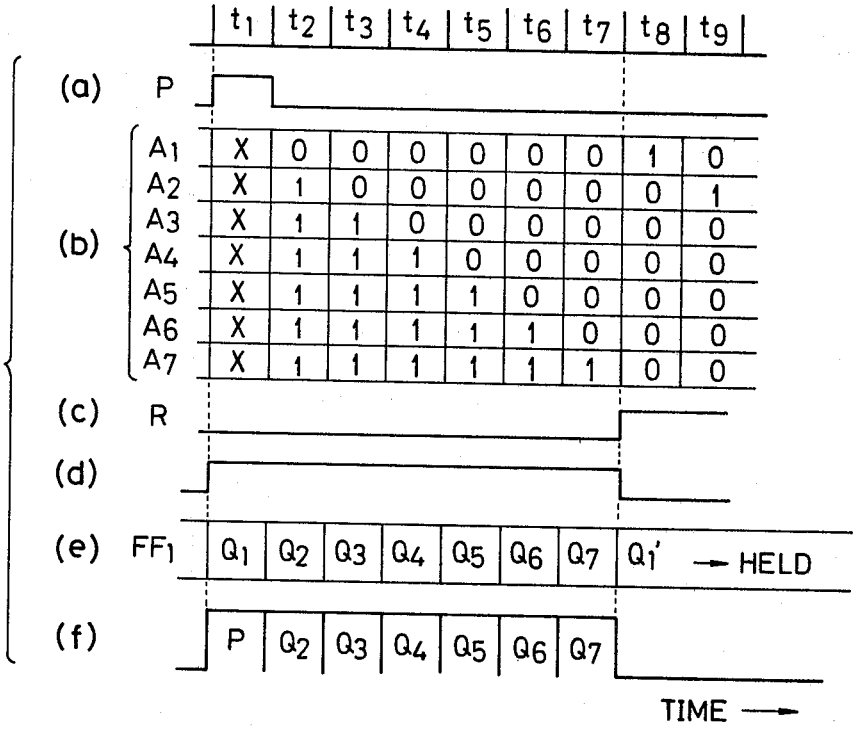
FIG. 5 is a timing chart for a description of an operation of the circuit in FIG. 4 in which wave data are produced in a series mode.

If the data held in the delay flip-flops FF1 through FF7 in the memory state (or when the memory line 59 is at "1") are designated by $Q_1$ through $Q_7$, respectively, then the data outputted by the delay flip-flop FF1 in the shift state (or when the shift line 58 is at "1") is as shown in the part (e) of FIG. 5. In other words, the data $Q_1$–$Q_7$ held by the register (FF1–FF7) are successively outputted, in a series mode, starting with the least significant bit by the delay flip-flop FF1. This output of the delay flip-flop FF1 is applied through an AND circuit 62 and an OR circuit 63 to the addition input terminal A of the adder 53. In this connection, the series addition operation will be described. First, the reference pulse P is applied through the OR circuit 55 and the AND circuit 56 to the addition input terminal Ci of the adder 53 in the time slot $t_1$. The AND circuit 56 is enabled by the signal "1" on the shift line 58 for the period of time of from the time slot $t_1$ to the time slot $t_7$. In this time slot $t_1$, the least significant bit's data $Q_1$ from the delay flip-flop FF1 is applied to the adder 53, so that the pulse P is added to the least significant bit's data $Q_1$. This addition result (designated by $Q_1'$) is inputted through the output terminal S to the delay flip-flop FF7, and the carry output Co at that time is applied to the delay flop-flop 54. In the next time slot $t_2$, the timing pulse P is eliminated, but the carry signal from the less significant bit, which has been temporarily held by the delay flip-flop 54, is applied to the addition input terminal Ci and is added to the data $Q_2$. Thereafter, similarly as in the above-described case, the addition of the carry signal from the addition result of the less significant bit to the data $Q_3$–$Q_7$ of the more significant bit is repeated. Thus, the series addition operation is completed in the time slot $t_7$. Upon completion of the series addition operation, the time slot $t_8$ occurs, and the output of the flip-flop 57 is set to "0" and the memory line 59 is therefore set to "1". Accordingly, the result of the addition carried out during the period of time of from the time slot $t_1$ to the time slot $t_7$ is self-held by the delay flip-flops FF1 through FF7. Therefore, the weights of the data $Q_1$ through $Q_7$ held in the delay flip-flops FF1 through FF7 are as follows: $2^1$ for FF1, $2^2$ for FF2, $2^3$ for FF3, $2^4$ for FF4, $2^5$ for FF5, $2^6$ for FF6, and $2^7$ for FF7. Thus, the reference timing signal P has been frequency-divided in a plurality of steps by the series addition effected in the octavely-related wave data forming section 40, the frequency division factors thereof corresponding to the above-described weights.

The octavely-related wave data $Q_1$–$Q_7$ thus formed by the octavely-related wave data forming section 40 are outputted, in a series mode, through the line 64, the OR circuit 65, and the AND circuit 66. The AND circuit 66 is enabled by the output of the flip-flop 57 for the period of time of from the time slot $t_1$ to the time slot $t_7$, and only during this period of time the octavelyrelated wave data are outputted. More specifically, the output data $Q_1$–$Q_7$ of the delay flip-flop FF1 provided as shown in the part (e) of FIG. 5 are delivered through the line 64, the OR circuit 65 and the AND circuit 66 to the line 30. Since the above-described series addition operation is carried out in the rear stage of the delay flip-flop FF1, the wave data $Q_1$–$Q_7$ provided through the line 64 is the preceding series addition result. In the time slot $t_1$, the reference timing pulse P is outputted to the line 30 through the OR circuit 65 and the AND circuit 66. This reference timing pulse P is always at "1" in the time slot $t_1$, and therefore takes precedence over the data $Q_1$. Thus, the data $Q_1$ is cancelled. Accordingly, the contents of the data delivered to the line 30 from the wave data generator section 18 are as shown in the part (f) of FIG. 5. That is, in practice, the octave-related wave data are superposed by arranging the wave data $Q_{22}$ through $Q_7$ in a series mode. The reference timing pulse P appearing before the wave data $Q_2$–$Q_7$ is utilized as a timing signal in arranging the octavely-related wave data in a parallel mode.

Figure 4:
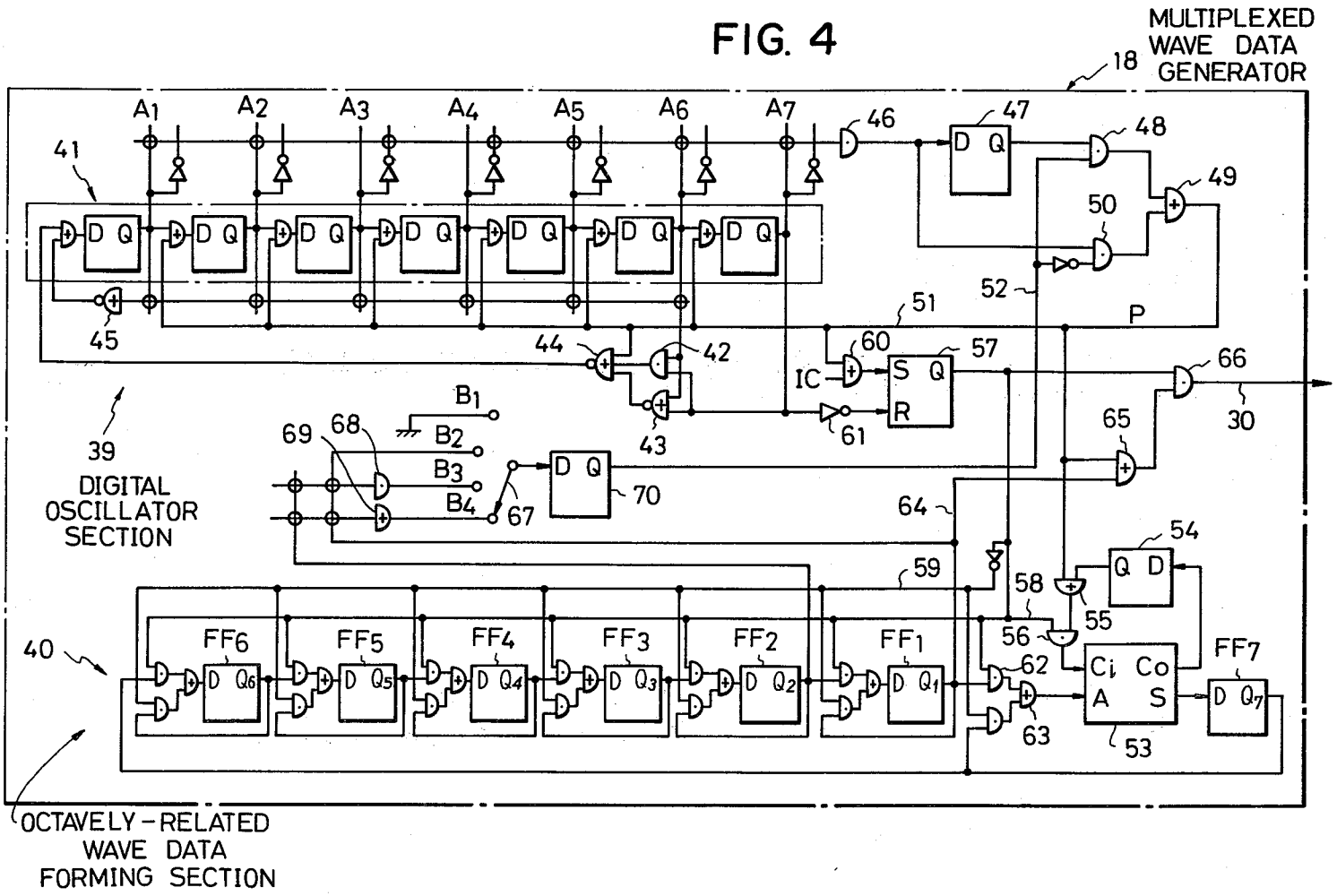
FIG. 4 is a circuit diagram, partly as block diagram, showing a fundamental example of a multiplexed wave data generator section shown in FIG. 1.

In the example shown in FIG. 4, the slight change of the generation interval of the reference timing pulse P is carried out in predetermined combination during a period of time in which four reference timing pulses P are provided. The combination is set according to the positions of a switch 67. The switch 67 has four terminals $B_1$, $B_2$, $B_3$ and $B_4$. The terminal $B_1$ is grounded. No signal "1" is applied to the terminal $B_1$ during the period of time in which four reference timing pulses are provided. The data $Q_1$ corresponding to the least significant bit is applied to the terminal $B_2$ by the delay flip-flop FF1 in the data forming section 40, and the signal "1" is applied to the terminal $B_2$ twice during the period of time in which four reference timing pulses P are provided. The data $Q_1$ and $Q_2$ held in the delay flip-flops FF1 and FF2 are applied to an AND circuit 68 and an OR circuit 69. The output of the AND circuit 68 is applied to the terminal $B_3$, and the output of the OR circuit 69 is applied to the terminal $B_4$. Accordingly, the signal "1" is applied to ther terminal $B_3$ only once during the period of time in which four reference timing pulses P are generated, while the signal "1" is applied to the terminal $B_4$ three times during the same period of time. The relations between the data $Q_1$ and $Q_2$ of the least significant bits and the values of the signals applied to the terminals $B_1$–$B_4$ of the switch 67 are as indicated in Table 1 below:

TABLE 1

| $Q_2$ | $Q_1$ | $B_4$ | $B_3$ | $B_2$ | $B_1$ |
|---|---|---|---|---|---|
| 0 | 0 | 0 | 0 | 0 | 0 |
| 0 | 1 | 1 | 0 | 1 | 0 |
| 1 | 0 | 1 | 0 | 0 | 0 |
| 1 | 1 | 1 | 1 | 1 | 0 |

The output of the switch 67 is applied through the delay flip-flop 70 to the control line 52, thereby to control the frequency division factor of the digital oscillation section and accordingly the generating interval of the reference timing pulse P. In the case where the frequency division factor set by the AND circuit 46 is base-N as was described before, the reference timing pulse P is generated in the frequency division factor of base-(N+1) when the signal on the control line 52 is set to "1", and the reference timing pulse P is generated in the frequency division factor of base-N when the signal on the control line 52 is set to "0". Accordingly, the frequency division factors for generating the reference timing pulses P in the digital oscillation section 39 is of the base-N at all times when the switch 67 is set to the terminal $B_1$; however, the frequency division factors of base-N and base-(N+1) are alternately repeated when the switch 67 is set to the terminal $B_2$; when the switch 67 is set to the terminal $B_3$, the frequency division factor of base-N is repeated three times, and thereafter the frequency division factor of base-(N+1) is effected only once; and when the switch 67 is set to the terminal $B_4$, the frequency division factor of base-N is effected once, and thereafter the frequency division factor of base-(N+1) is repeated three times.

Figure 6:
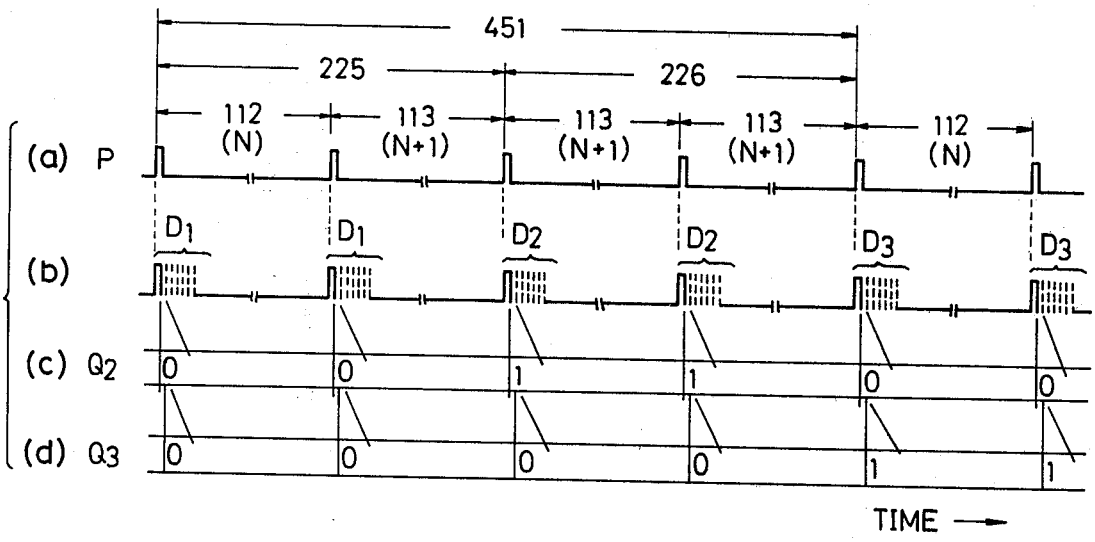
FIG. 6 is also a timing chart for a description of the production of series wave data provided by the circuit shown in FIG. 4.

In the example shown in FIG. 4, the switch 67 is set to the terminal $B_4$. And the input condition of the AND circuit 46 in the digital oscillation section 39 is set to "$A_1.A_2.\overline{A_3}.\overline{A_4}.A_5.A_6.A_7$". which means that the maximum length counter is set to base-112 (N=112). In this case, generation of the reference timing pulse P is as shown in the part (a) of FIG. 6, in which reference numerals designates the numbers of clock pulses included therein, that is, the frequency division factor with the clock pulses as the reference. As was described before, the data bits $Q_2$–$Q_7$ following after the reference timing pulse P are outputted, in a series mode, by the AND circuit 66. The part (b) of FIG. 6 shows a state of generation of these octavely-related wave data trains $D_1$, $D_2$, $D_3$, —. Each data ($D_1$, $D_2$, $D_3$, —) includes the reference timing pulse P followed by the six data bits $Q_2$–$Q_7$ as shown in the part (f) of FIG. 5. As the data bit $Q_2$ which is least in frequency division factor is obtained by subjecting the reference timing pulse P to $\frac{1}{4}$ frequency division, the level of the data bit $Q_2$ is changed to "1" or "0" whenever two reference timing pulses P are provided. Therefore, in the case where the frequency data trains are produced with the generation period of the reference timing pulse, each data train appears twice as $D_1$, $D_1$, $D_2$, $D_2$, as shown in part (b) of FIG. 6. The circuit may be so designed that each of the wave data trains $D_1$, $D_2$, —appears only once; however, there will be no trouble even if each data train appears two times as in this example. The contents of the data bits $Q_2$ and $Q_3$ are shown in the parts (c) and (d) of FIG. 6, as examples of the contents of the data trains $D_1$, $D_2$, $D_3$, —. The variations of the data contents of the frequency data trains $D_1$, $D_2$, $D_3$, — with the lapse of a long time are indicated in Table 2 below:

TABLE 2

| data train | data bit $Q_2$ | $Q_3$ | $Q_4$ | $Q_5$ | $Q_6$ | $Q_7$ | data train | data bit $Q_2$ | $Q_3$ | $Q_4$ | $Q_5$ | $Q_6$ | $Q_7$ |
|---|---|---|---|---|---|---|---|---|---|---|---|---|---|
| $D_1$ | 0 | 0 | 0 | 0 | 0 | 0 | $D_{21}$ | 0 | 0 | 1 | 0 | 1 | 0 |
| $D_2$ | 1 | 0 | 0 | 0 | 0 | 0 | $D_{22}$ | 1 | 0 | 1 | 0 | 1 | 0 |
| $D_3$ | 0 | 1 | 0 | 0 | 0 | 0 | $D_{23}$ | 0 | 1 | 1 | 0 | 1 | 0 |
| $D_4$ | 1 | 1 | 0 | 0 | 0 | 0 | $D_{24}$ | 1 | 1 | 1 | 0 | 1 | 0 |
| $D_5$ | 0 | 0 | 1 | 0 | 0 | 0 | $D_{25}$ | 0 | 0 | 0 | 1 | 1 | 0 |
| $D_6$ | 1 | 0 | 1 | 0 | 0 | 0 | $D_{26}$ | 1 | 0 | 0 | 1 | 1 | 0 |
| $D_7$ | 0 | 1 | 1 | 0 | 0 | 0 | $D_{27}$ | 0 | 1 | 0 | 1 | 1 | 0 |
| $D_8$ | 1 | 1 | 1 | 0 | 0 | 0 | $D_{28}$ | 1 | 1 | 0 | 1 | 1 | 0 |
| $D_9$ | 0 | 0 | 0 | 1 | 0 | 0 | $D_{29}$ | 0 | 0 | 1 | 1 | 1 | 0 |
| $D_{10}$ | 1 | 0 | 0 | 1 | 0 | 0 | $D_{30}$ | 1 | 0 | 1 | 1 | 1 | 0 |
| $D_{11}$ | 0 | 1 | 0 | 1 | 0 | 0 | $D_{31}$ | 0 | 1 | 1 | 1 | 1 | 0 |
| $D_{12}$ | 1 | 1 | 0 | 1 | 0 | 0 | $D_{32}$ | 1 | 1 | 1 | 1 | 1 | 0 |
| $D_{13}$ | 0 | 0 | 1 | 1 | 0 | 0 | $D_{33}$ | 0 | 0 | 0 | 0 | 0 | 1 |
| $D_{14}$ | 1 | 0 | 1 | 1 | 0 | 0 | $D_{34}$ | 1 | 0 | 0 | 0 | 0 | 1 |
| $D_{15}$ | 0 | 1 | 1 | 1 | 0 | 0 | $D_{35}$ | 0 | 1 | 0 | 0 | 0 | 1 |
| $D_{16}$ | 1 | 1 | 1 | 1 | 0 | 0 | $D_{36}$ | 1 | 1 | 0 | 0 | 0 | 1 |
| $D_{17}$ | 0 | 0 | 0 | 0 | 1 | 0 | D. | | | . | | | |
| $D_{18}$ | 1 | 0 | 0 | 0 | 1 | 0 | . | | | . | | | |
| $D_{19}$ | 0 | 1 | 0 | 0 | 1 | 0 | . | | | . | | | |
| $D_{20}$ | 1 | 1 | 0 | 0 | 1 | 0 | $D_{128}$ | 1 | 1 | 1 | 1 | 1 | 1 |

Among the data bits $Q_2$–$Q_7$, the level of the data bit $Q_2$ is changed to "1" and "0" at the shortest period. Therefore, a wave generated according to the data bit $Q_2$ has the highest frequency. As is apparent from the numberals in the part (a) of FIG. 6, the wave obtained according to the data bit $Q_2$ is one which is obtained by subjecting the delay flip-flop driving clock pulse to 1/451 frequency division. That is, the data bit $Q_2$ is obtained by subjecting the reference timing pulse P to $\frac{1}{4}$ frequency division, and in this case four reference timing pulses P are produced by performing 1/113 frequency division three times after the clock pulse has been subjected to 1/112 frequency division once. The signal wave obtained from the respective data bits $Q_3$, $Q_4$, $Q_5$, $Q_6$ and $Q_7$ are ones which are obtained by subjecting the highest frequency signal corresponding to the data bit $Q_2$ to $\frac{1}{2}$, $\frac{1}{4}$, $\frac{1}{8}$, 1/16 and 1/32 frequency division, respectively. Thus, the plural waves in octave relations are generated in multiplexed state (in a series mode).

The reason for slightly changing the frequency division factor with the switch 67 is to provide an intricate frequency division factor which cannot be realized only with the maximum length counter using the 7-stage shift counter. More specifically, if the AND circuit 46 operates when the maximum length counter is operated on the base-N, it is possible to obtain the data bit $Q_2$ in slightly different frequency division factors of base-(4N), base-(4N+1), base-(4N+2) and base-(4N+3) respectively corresponding to the four terminals $B_1$ through $B_4$ of the switch 67.

As was described above, the wave data $Q_2$–$Q_7$ in multiplexed state in a series mode are outputted by the multiplexed wave data generator section 18.

The multiplexed wave data generator sections 18-1 through 18-12 in FIG. 1 may be formed similarly as in the multiplexed wave data generator section 18 in FIG. 4. However, it should be noted that in FIG. 4 the wave data $Q_2$–$Q_7$ are of 6 bits for simplification in description, but they are, in practice in electronic musical instruments, of 9 bits to cover ten octaves. Accordingly, each of the multiplexed (series) frequency data trains delivered to the respective lines 30-1 through 30-12 from the multiplexed wave data generator sections 18-1 through 18-12 consists of the data of 10-bits including the reference timing pulse P. Accordingly, it goes without saying that the shift register in the octavely related wave data forming section 40 and the shift register in the digital oscillation section 39 are formed as 10-stage shift registers.

In the multiplexed wave data generator sections 18-1 through 18-12 respectively corresponding to the notes, the input connection states of the AND circuits (46) in the digital oscillation sections (39) thereof and the setting states of the frequency division factor fine-adjusting switches thereof are different from one another, so that each of the wave data each corresponding to the frequency of each of the notes C-B are generated in multiplexed state on the respective output lines 30-1 through 30-12. That is, in the multiplexed wave data generator sections 18-1 through 18-12, the frequency division factors are set according to the frequencies of the respective notes.

(Tone Waveform Generating Section)

Figure 7:
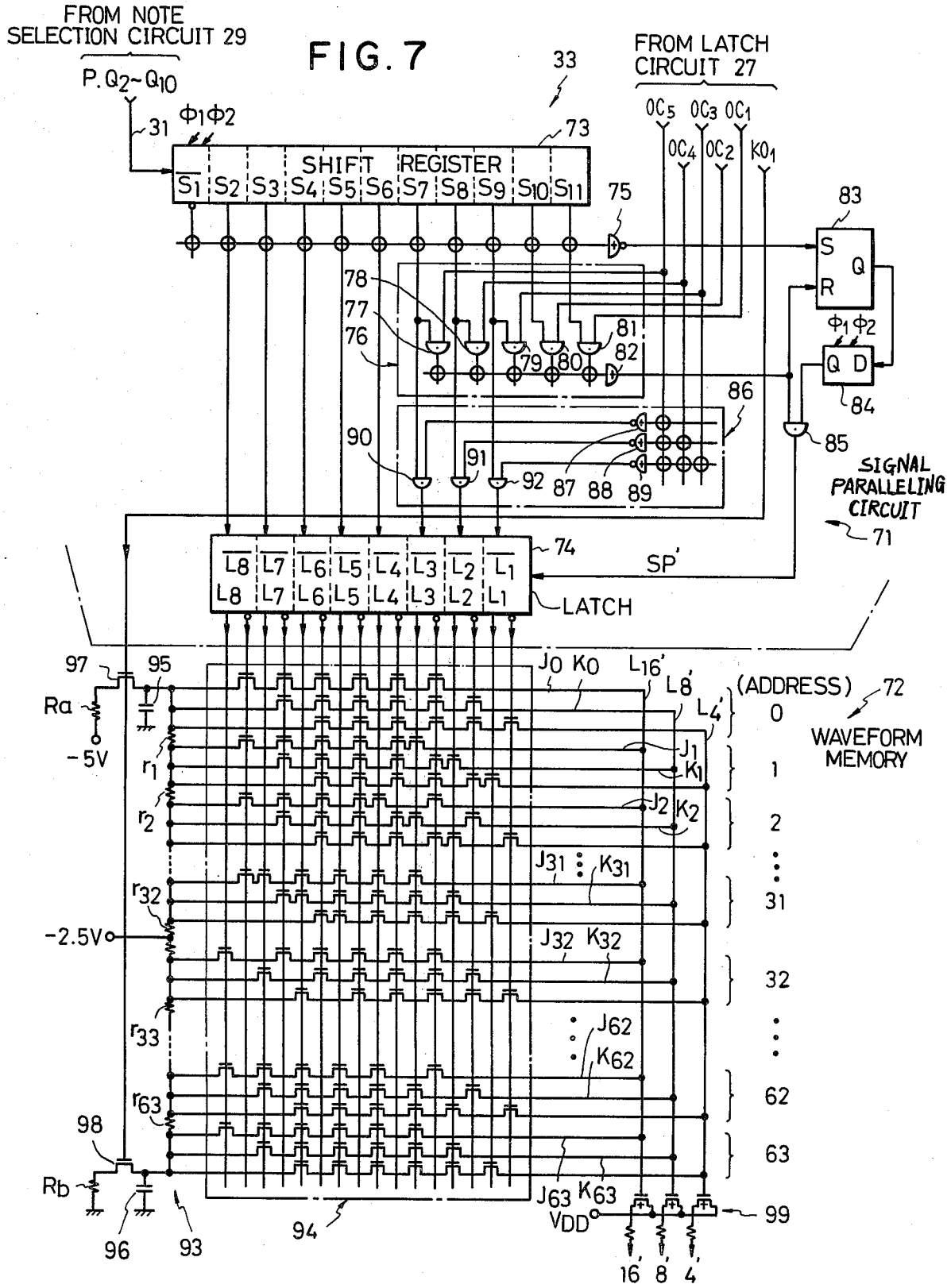
FIG. 7 is a circuit diagram, partly as a block diagram, showing one example of a tone waveform generating section adapted to provide saw tooth waveforms in FIG. 1.

FIG. 7 shows one example of the tone waveform generating section 33 adapted to generate saw tooth waveform signals. The tone waveform generating section 33 can be roughly divided into a signal aparalleling circuit 71 and a waveform memory 72.

(1) Description of the Signal Paralleling Circuit 71

The signal paralleling circuit 71 operates to receive through the line 31 the multiplexed wave data P, $Q_2$–$Q_{10}$ (the part of the wave data $Q_2$–$Q_{10}$ being 9 bits as described before) and to convert the data into parallel data. The multiplexed wave data P, $Q_2$–$Q_{10}$ supplied through the line 31 are applied to the first stage $S_1$ of a series-input/series-shift/parallel-output type shift register 73, and are successively shifted from the first stage $S_1$ to the eleventh stage $S_{11}$. Accordingly, signals obtained by converting the multiplexed wave data P, $Q_2$–$Q_{10}$ into the parallel data are provided by the stages of the shift register 73, respectively. As the multiplexed wave data is supplied intermittently just after every generation timing of the timing pulse P, the data paralleled by the shift register 73 are latched by a latch circuit 74 to be formed as continuous signals.

The data bits $Q_2$–$Q_7$ latched by the latch circuit 74 are used as address specifying signals to read waveforms stored in the waveform memory 72. In the waveform memory 72, one period waveform of a saw tooth waveform are divided by 64 sample points, and the amplitude values at the sample points are stored in the respective addresses thereof.

The shift register 73 is operated by the same clock pulses as the clock pulses $\phi_1$ and $\phi_2$ used in the multiplexed wave data generator sections 18-1 through 18-12. The multiplexed wave data are inputted into the shift register 73 in the order of P, $Q_2$, $Q_3$, $Q_4$, $Q_5$, $Q_6$, $Q_7$, $Q_8$, $Q_9$ and $Q_{10}$. At the timing $t_1'$, the reference timing pulse P at the top of the data is inputted into the shift register, and the contents of the data in the stages $S_1$ through $S_{11}$ in the shift register 73 at the timings $t_1'$ through $t_{11}'$ are as indicated in the part (a) of FIG. 8.

An output $\overline{S_1}$ obtained by inverting the output of the 1st stage $S_1$ of the shift register 73 and the outputs of the 2nd through 11th stages are applied to a NOR circuit 75 which is to detect the reference pulse P(or to detect the arrival of the frequency data $Q_2$–$Q_{10}$). The outputs of the 7th through 11th stages in the shift register 73 are applied to AND circuits 77 through 81 in an octave switching circuit 76, respectively. The octave switching circuit 76 is to shift the bit positions of the frequency data $Q_2$–$Q_{10}$ paralleled by the shift register 73 according to the octave signals $OC_1$–$OC_5$. After this shift control by the octave switching circuit 76, the parallel data bits $Q_2$–$Q_{10}$ are latched by the latch circuit 74. The octave signals $OC_1$–$OC_5$ are supplied from the latch circuit 27 (FIG. 1) and the octave signal (one of the octave signals $OC_1$–$OC_5$) corresponding to the octave range of the note assigned to the channel is at "1", and the remaining octave signals are at "0". The weights of the data bits $Q_2$, $Q_3$, $Q_4$, $Q_5$, $Q_6$, $Q_7$, $Q_8$, $Q_9$ and $Q_{10}$ are $2^0$, $2^1$, $2^2$, $2^3$, $2^4$, $2^5$, $2^6$, $2^7$, and $2^8$, respectively. Accordingly, the value of the parallel data is changed in the rate of $2^n$ by shifting these bit positions, and therefore the octave ranges can be switched.

In the octave switching circuit 76, the octave signal $OC_1$ corresponding to the first octave range is applied to the AND circuit 81, and the octave signal $OC_2$ corresponding to the second octave range is applied to the AND circuit 80. Furthermore, the octave signals $OC_3$, $OC_4$ and $OC_5$ corresponding to the third, fourth and fifth octave ranges are applied to the AND circuits 79, 78 and 77, respectively. Thus, only the AND circuit (one of the AND circuits 77 through 81) which corresponds to the octave range of the note assigned to the channel, is enabled. When the reference timing pulse P is shifted to the stage (one of the stages $S_7$ through $S_{11}$) corresponding to the AND circuit (77–81) thus enabled, the AND circuit (77–81) is operated to apply the signal "1" to an OR circuit 82.

The arrival of the data bits $Q_2$–$Q_{10}$ to the shift register 73 through the line 31 is detected as follows:

Since the wave data $Q_2$–$Q_{10}$ are delivered out after the reference timing pulse P at all times, no signal is provided to the line 31 at least for 10 bit times immediately before the arrival of the reference timing pulse P to the line 31 (that is, the line 31 is at "0"). Accordingly, when the reference timing pulse P is inputted into the first stage $S_1$ of the shift register 73, all the outputs of the 2nd through 11th stage $S_{11}$ representative of the signal state in 10 bit times immediately before this are at "0". This time instant is indicated by the timing $t_1'$ in the part (a) of FIG. 8. As the reference timing pulse P has been inputted into the first stage $S_1$ in the shift register 73, the inverted output $\overline{S_1}$ of the first stage $S_1$ is set to "0". The NOR circuit 75, being supplied with the first stage inverted output $S_1$ and the outputs of the 2nd through 11th stages, produces the output "1" at the timing $t_1'$.

The output of the NOR circuit 75 is applied to the set input terminal S of a set-reset (S-R) type flip-flop 83. As a result, the flip-flop 83 is placed in set state as shown in the part (b) of FIG. 8, and its set output signal, after being delayed by 1 bit time by a delay flip-flop 84 as shown in the part (c) of FIG. 8, is applied to an AND circuit 85 thereby to enable the latter 85.

The outputs of the above-described AND circuits 77 through 81 are applied to the AND circuit 85 through the OR circuit 82 and to the reset input terminal R of the flip-flop 83. Since the reference timing pulse P appears before the data bits $Q_2$–$Q_{10}$ at all times, when the output "1" is provided by the AND circuits 77 through 81 in response to the reference timing pulse P, an initial reset signal is applied to the flip-flop 83 to reset the latter 83. At the same time, the condition of the AND circuit 85 is satisfied, and therefore the output "1" of the AND circuit 85 is applied to the strobe input terminal of the latch circuit 74. In one bit time after the flip-flop 83 has been reset, the output of the delay flip-flop 84 is set to "0". Therefore, even if the output "1" is thereafter provided by the OR circuit 82, the AND circuit 85 will not operate. Accordingly, the strobe pulse SP' applied to the latch circuit 74 from the AND circuit 85 is produced only for one bit time.

The timing of production of this strobe pulse SP' is determined by the octave signals $OC_1$–$OC_5$.

Figure 8:
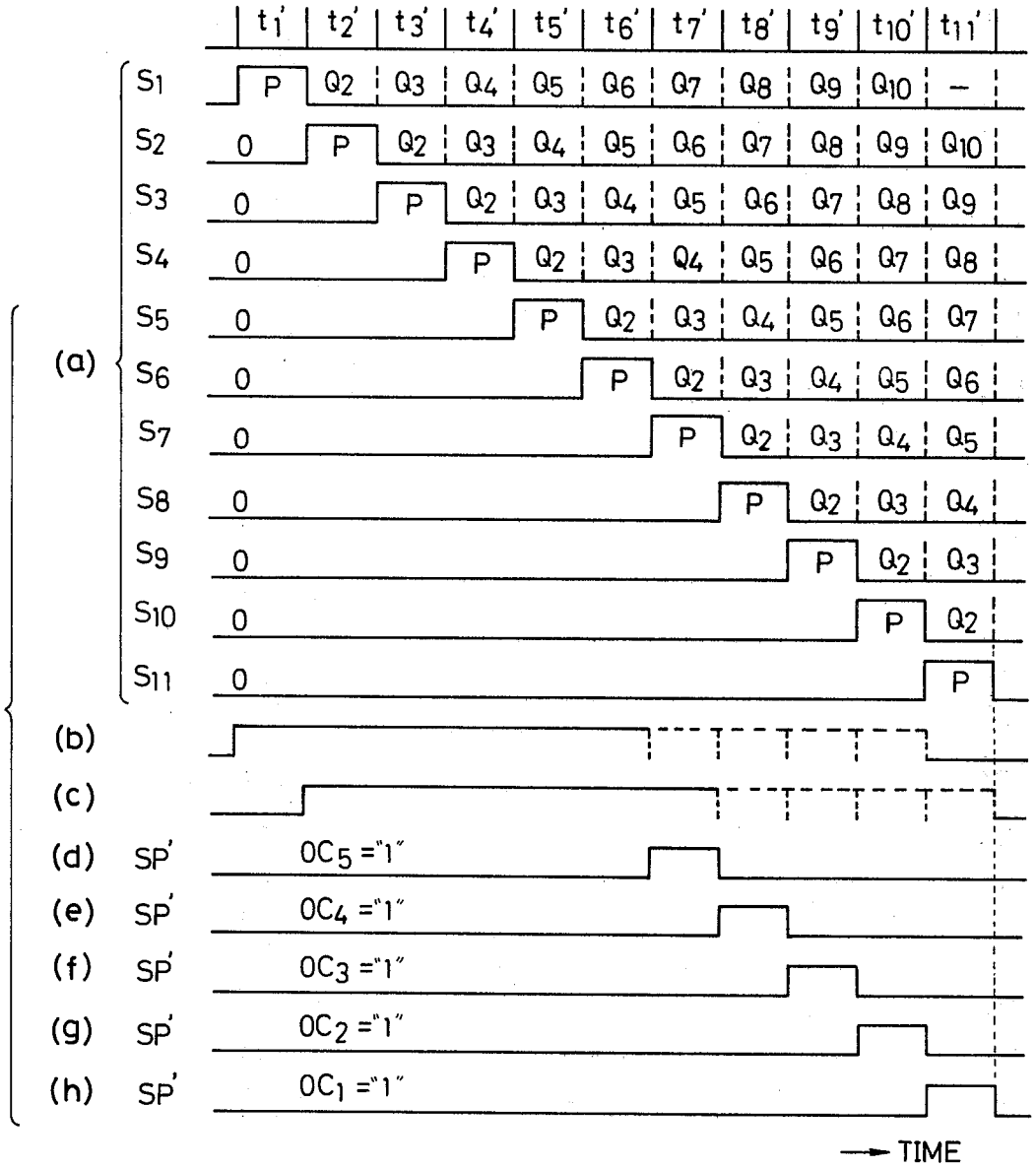
FIG. 8 is a timing chart for a description of the operation of a signal paralleling circuit section in FIG. 7.

In the case where the octave signal $OC_5$ is at "1", when the reference timing pulse P is applied to the 7th stage of the shift register 73, the AND circuit 77 is operated, and the strobe pulse SP' is provided at the timing $t_7'$ (FIG. 8, (d)). In this case, the data $Q_6$, $Q_5$, $Q_4$, $Q_3$ and $Q_2$ have been inputted into the stages $S_2$–$S_6$ of the shift register 73, respectively (cf. FIG. 8, (a)). Therefore, these data $Q_2$–$Q_6$ are inputted into the latch circuit 74.

The latch circuit 74 has eight latch positions $L_1$ through $L_8$, the latch position $L_8$ corresponding to the weight of the most significant bit, the latch position $L_1$ to the weight of the least significant bit. The outputs of the second through sixth stage ($S_2$–$S_6$) of the shift register 73 are applied to the latch positions $L_8$ through $L_4$ of the latch circuit 74, and the outputs of the 7th through 9th stages ($S_7$–$S_9$) of the same 73 are applied through a gate circuit 86 to the latch positions $L_3$ through $L_1$, respectively.

Thus, when the strobe pulse SP' is produced at the timing $t_7'$, the data $Q_6$–$Q_2$ are inputted into the latch positions $L_8$–$L_4$ of the latch circuit 74, respectively. The data $Q_2$ is at the top of the data $Q_2$–$Q_{10}$. The reference timing pulse P is in the stage next to the stage where this data $Q_2$ is present, in the shift register 73. The reference timing pulse P is to indicate the timing of presence of the multiplexed wave data, and therefore it is unnecessary when the wave data $Q_2$–$Q_{10}$ have been paralleled and latched. For this reason, the gate section 86 is provided so that the reference timing pulse P used out is not latched by the latch circuit 74. In other words, the gate section 86 is a circuit which prevents inputting into the latch circuit 74 the output of the stage of the shift register 73, which stage is positioned before the stage where the top data $Q_2$ is inputted. When the octave signal $OC_5$ is at "1", all the outputs of NOR circuits 87, 88 and 87 are set to "0", and therefore all AND circuits 90, 91 and 92 corresponding to the stages $S_7$, $S_8$ and $S_9$ of the shift register 73 are disabled. Thus, with the octave signal $OC_5$ at "1", the outputs of the stages $S_7$ through $S_9$ of the shift register 73 are not inputted to the latch positions $L_1$ through $L_3$ of the latch circuit 74. In the case where the octave signal $OC_5$ is at "1", by this operation of the gate section 86 no data are inputted to the latch positions $L_3$, $L_2$ and $L_1$ which are lower in weight than the latch position $L_4$ where the data $Q_2$ lowest in weight is latched.

Whenever the multiplexed wave data $Q_2$–$Q_{10}$ is provided, or whenever the wave data train (as $D_1$, $D_2$, $D_3$,—in Table 2) together with the reference timing pulse is applied, the contents of the data bits $Q_2$–$Q_6$ stored in the latch positions $L_4$ through $L_8$ of the latch circuit 74 are rewritten. The levels ("1" or "0") of signals outputted by the latch positions $L_4$ through $L_8$ are changed respectively whenever the logical levels of the data bits $Q_2$–$Q_6$ supplied through the line 31 are changed. Thus, 4-bit binary signals obtained by making the data bits $Q_2$–$Q_6$ parallel are provided by the latch positions $L_4$ through $L_8$ of the latch circuit 47.

In the case where the octave signal $OC_4$ representing the fourth octave is at "1", the strobe pulse SP' is produced when the reference timing pulse P is inputted into the eighth stage $S_8$ of the shift register 73 (cf. FIG. 8, (e)). In this case, the data bits $Q_7$, $Q_6$, $Q_5$, $Q_4$, $Q_3$ and $Q_2$ have been inputted into the stages $S_2$ through $S_7$ as indicated in the column of timing $t_8'$ in the part (a) of FIG. 8. In addition, the outputs of the NOR circuits 88 and 89 in the gate section 86 are set to "0" by the octave signal $OC_4$, as a result of which the AND circuit 91 and 92 are disabled, that is, only the AND circuit 90 is enabled. Therefore, the data $Q_2$ in the stage $S_7$ is inputted through the AND circuit 90 to the latch position $L_3$. Thus, the frequency data $Q_2$–$Q_7$ are latched in the latch positions $L_3$ through $L_8$ in response to the strobe pulse SP' provided at the timing $t_8'$.

In the case where the octave signal $OC_3$ corresponding to the third octave range is at "1", the strobe pulse SP' is produced when the reference timing pulse P is inputted into the 9th stage of the shift register 73 (FIG. 8, (f)). In this case, the data $Q_8$, $Q_7$, $Q_6$, $Q_5$, $Q_4$, $Q_3$ and $Q_2$ are inputted into the stages $S_2$ through $S_8$ of the shift register 73. The output of the NOR circuit 89 of the gate section 86 is set to "0" by the octave signal and the AND circuit 92 is therefore disabled. However, as the AND circuits 90 and 91 are operable, the data $Q_2$ and $Q_3$ in the stages $S_8$ and $S_7$ of the shift register 73 are applied through the AND circuits 90 and 91 to the latch positions $L_2$ and $L_3$. Accordingly, the data $Q_2$ through $Q_8$ are latched in the latch positions $L_2$ through $L_8$ in response to the strobe pulse SP' produced at the timing $t_9'$.

In the case where the octave signal $OC_2$ or $OC_1$ is at "1", the AND circuits 90 through 92 are enabled and therefore the outputs of the stages $S_7$, $S_8$ and $S_9$ are inputted into the latch positions $L_3$, $L_2$ and $L_1$ of the latch circuit 74 at all times. In the case where the octave signal $OC_2$ is at "1", the strobe pulse SP' is produced when the reference timing pulse P is inputted into the stage $S_{10}$ of the shift register 73 (FIG. 8, (g)). In this case, as the data $Q_9$–$Q_2$ are inputted into the stages $S_2$–$S_9$ of the shift register 73, the data $Q_2$–$Q_9$ are latched in the latch positions $L_1$–$L_8$ of the latch circuit 74. In the case where the octave signal $OC_1$ is at "1", the strobe pulse SP' is produced when the reference timing pulse P is inputted into the stage $S_{11}$ of the shift register 73 (FIG. 8, (h)). In this case, as the data $Q_{11}$–$Q_3$ are inputted into the stages $S_2$–$S_9$ of the shift register 73, the data $Q_3$ through $Q_{10}$ are latched in the latch positions $L_1$ through $L_8$ of the latch circuit 74, respectively.

As is apparent from the above description, when the respective bit data $Q_2$–$Q_{10}$ are latched in a parallel mode, the bit positions of the data $Q_2$–$Q_{10}$ are shifted according to the contents of the octave signals $OC_1$–$OC_5$ (the octave range of the note assigned to the relevant channel), and are latched, in this shift stage, by the latch circuit. The amount of this shift is such that the bit positions are shifted right (or left) whenever the octave range is decreased (or increased) by one octave. Thus, the value of a binary signal (that is, the address signal of the waveform memory 72) constituted by the outputs of the latch positions $L_1$ through $L_8$ of the latch circuit 74 is switched at the rate of $2^n$ according to the octave signals $OC_1$–$OC_5$.

(2) Description of the Waveform Memory 72

The waveform memory 72 comprises: a waveform amplitude voltage generating circuit 93 having a resistance type voltage division circuit; and an amplitude voltage reading gate circuit 94.

In the waveform amplitude voltage generating circuit 93, a voltage between capacitors 95 and 96 is divided into 63 partial voltages by 63 resistors $r_1$ through $r_{63}$ which are equal in resistance and are series-connected, whereby sample point amplitude voltages of one period waveform of a saw tooth wave having 64 sample points are produced. The key-on signal $KO_1$ supplied from the latch circuit 27 (FIG. 1) is applied to the gate electrodes of field-effect transistors 97 and 98 to render the latter 97 and 98 conductive, so that, while a key is depressed, the capacitor 95 is charged by a voltage of −5 V and the capacitor 96 is grounded. The capacitors 95 and 96 are to give an envelope to a read waveform, and the attack property of the envelope is determined by the time constant of a resistor Ra (Rb) and the capacitor 95 (96). Thus, during the key depression, the voltage between −5 V and the ground is divided into 63 parts. The 64 sample points correspond to addresses 0 through 63. The address 0 is the voltage (−5 V) of the capacitor 95, the address 1 is a voltage obtained between the resistors $r_1$ and $r_2$, and so forth as is clear from the figure. The central point of the central resistor $r_{32}$ (between the addresses 31 and 32) is connected to an amplitude central voltage (−2.5 V) so that after key release the waveform is decayed toward the zero level. In other words, when the key-on signal $KO_1$ is set to "0" upon key release, the field-effect transistors 97 and 98 are rendered non-conductive, whereby the central voltage −2.5 V is applied to the capacitors 95 and 96 through an equal resistance ($r_1$—a half of $r_{32}$; and a half or $r_{32}$–$r_{63}$). As a result, the decay property of the envelope is provided.

In the waveform memory 72, the waveforms of 4-foot register (4'), 98-foot register (8') and 16-foot register (16') are read out simultaneously, and the waveform amplitude voltage generating circuit 93 is used commonly for these footage registers. For this purpose, three voltage leading paths are provided for each voltage leading point corresponding to each address as shown in FIG. 7.

In the amplitude voltage reading gate circuit 94, a series gate group constituted by a plurality of (six in FIG. 7) field-effect transistors series-connected is connected to each voltage leading point. The data octave-related wave ($Q_2$–$Q_{10}$) latched by the latch circuit 74 is applied as a reading address specifying signal to the gate circuit 94. As the number of addresses is 64, six bits of the outputs $L_1$–$L_8$ of the latch circuit 74 are used as the address specifying signal. Signals consisting of predetermined six bits output the outputs $L_1$–$L_8$ of the latch circuit 74 are applied, in combinations corresponding to respective addresses, to the respective series gate groups in the reading gate circuit 94. When all the six field-effect transistor in one series gate group are conductive (on), the voltage at the voltage leading point of the series gate group is introduced. For this purpose, the inverted outputs $\overline{L_1}$–$\overline{L_8}$ of the latch positions $L_1$–$L_8$ of the latch circuit 74 are effectively employed. For instance, consider the address 0. As its address specifying signal is "0 0 0 0 0 0", the inverted outputs $\overline{L_3}$–$\overline{L_8}$ of the latch positions $L_3$–$L_8$ are applied to the gate electrodes of the six field-effect transistors on a line $J_0$ corresponding to the 16-foot register, respectively. Accordingly, when all the latch data of the latch positions $L_3$–$L_8$ are at "0", the inverted outputs $\overline{L_3}$–$\overline{L_8}$ are all set to "1", whereby the line $J_0$ becomes conductive so that the amplitude voltage of the address 0 is introduced to an output line $L_{16}$, of the 16-foot register.

In the address specifying signal of the 16-foot system, the latch position $L_3$ of the latch circuit 74 is of the least significant bit, and the latch position $L_8$ is of the most significant bit. Therefore, the output of the latch circuit 74 having a combination of $\overline{L_8}$, $\overline{L_7}$, $\overline{L_6}$, $\overline{L_5}$, $\overline{L_4}$ and $\overline{L_3}$ is applied to the gate electrodes of the field-effect transistors on a line $J_1$ corresponding to the address 1, and the line $J_1$ becomes conductive when the signal of the latch positions $L_8$–$L_3$ is "0 0 0 0 0 1". Similarly as in the above-described case, with respect to the remaining addresses, conductive states occur in combinations corresponding to the respective addresses, and the reading lines $J_0$ through $J_{63}$ of the addresses of the 16-foot register are connected to the output line $L_{16}'$.

The arrangements of the gate circuit for the 8-foot register and the 4-foot register are similar to that described above. However, as the pitch of a note in the 8-foot register is twice as high as that of a note in the 16-foot register, the data of the latch positions $L_2$–$L_7$ in the latch circuit 74 is used as its address specifying signal. That is, the series gate groups on lines $K_0$ through $K_{63}$ are for the 8-foot register and are connected to an 8-foot register output line $L_8'$. The data of the latch positions $L_3$–$L_8$ repeatedly carries out an increment from "0 0 0 0 0 0" to "1 1 1 1 1 1" at a rate twice as high as the data of the latch positions $L_3$–$L_8$. Thus, the read waveform's frequency is twice as high. In the case of the 4-foot register, the data of the latch positions $L_1$–$L_6$ is employed as its address specifying signal. As the data of the latch positions $L_1$–$L_6$ repeatedly carries out an increase from "0 0 0 0 0 0" to "1 1 1 1 1 1" at a rate twice as high as the data of the latch positions $L_2$–$L_7$, a frequency twice as high as that in the 8-foot register, that is, a waveform signal of the 4-foot register can be obtained. The read out outputs concerning the 4-foot register are connected to a line $L_4'$.

The signals on the output lines $L_{16}'$, $L_8'$ and $L_4'$ for these footage registers are delivered out of the waveform 72 through depletion type field-effect transistors 99 source-follower-connected, respectively.

Now, the above description will be consolidated. The combinations of the octavely-related wave data $Q_2$–$Q_{10}$ used as the waveform reading address specifying signals are indicated in FIG. 9 separately according to the footage registers and the octaves.

Figure 9:
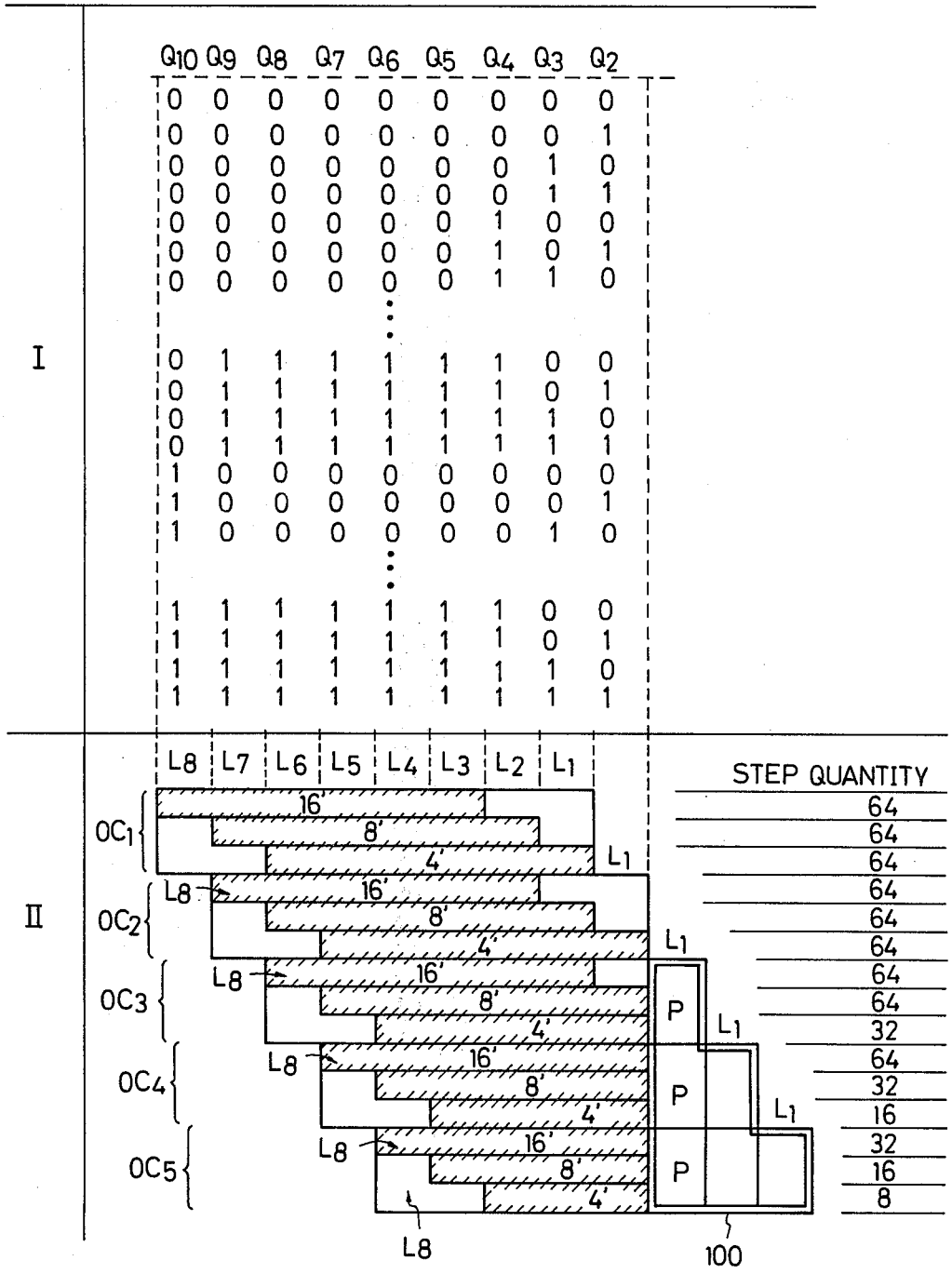
FIG. 9 is a diagram showing variations of multiplexed wave data $Q_2$–$Q_{10}$ which are arranged into parallel data in the signal paralleling circuit in FIG. 7, and showing a part of the data $Q_2$–$Q_{10}$ separately according to octave ranges and footage registers, the part being used as an address specifying signal for reading a waveform out of a vwaveform memory.

First, signal states obtainable by the 9-bit data $Q_2$–$Q_{10}$ are indicated in column I in FIG. 9. The period of inverting the least significant bit data $Q_2$ (that is, the period of changing the contents of the data $Q_2$–$Q_{10}$) is different depending on the notes. This period is preset by the multiplexed wave data generator sections 18-1 through 18-12 (FIG. 2). In column II of FIG. 9, the latch positions $L_1$–$L_8$ where the data $Q_2$–$Q_{10}$ are latched in the latch circuit 74 are indicated separately according to the octaves $OC_1$ through $OC_5$. The positions of the frequency data $Q_2$–$Q_{10}$ are allowed to correspond to the column I without being shifted, but the positions of the latch positions $L_1$ through $L_8$ are shown shifted in FIG. 9. The frames designated by 16', 8' and 4' in the frames of the octaves $OC_1$ through $OC_5$ indicate the ranges of the wave data ($Q_2$–$Q_{10}$) which are used as the waveform reading address specifying signals for the 16-foot register, the 8-foot register and the 4-foot register. The portion surrounded by the dual frame 100 in the frames of the third, fourth and fifth octaves $OC_3$, $OC_4$ and $OC_5$ is a portion which is prevented from being latched by the latch circuit with the aid of the gate circuit 86, that is, a portion including the reference timing signal P following the wave data $Q_2$.

As is apparent from reference to the columns I and II in FIG. 9, by switching the bit positions of the wave data $Q_2$–$Q_{10}$ to take out six bits for the address signal according to the octave range and the footage of the tone to be produced, a waveform signal having a frequency of a desired octave and footage can be read out.

Numerals 64, 32, 16 and 8 indicated on the right-hand side of the column II of FIG. 9 indicate the number of steps for forming one waveform (i.e. sample quantities). When all of the six bits of the address signal are changed, the number of steps of one waveform becomes 64. However, in the range of higher frequency, only several more significant bits of the address signal are changed, but the remaining less significant bits are not changed, and therefore the number of steps in one waveform is reduced as much. That is, the bits in the dual frame 100 are at "0" at all times, and only 5 bits, 4 bits or 3 bits higher in significance than that are changed, and therefore the number of steps becomes 32, 16 or 8.

(3) Description of the Tone Waveform Generating Section 32

The musical tone waveform generating section 32 may be arranged similarly as in the tone waveform generating section 33 described with reference to FIG. 7. Moreover, it is preferable that the section 32 is formed as shown in FIG. 10, because the contents of a waveform memory can be reduced. That is, in the case of a symmetrical waveform such as a sine wave, it is unnecessary to store all of one period waveform thereof in the waveform memory. If a half period waveform thereof is stored, the remaining half period waveform can be read by advancing the reading address in the opposite direction. The tone waveform generating section 32 shown in FIG. 10 is formed on this principle. In FIG. 10, a shift register 73, a latch circuit 74, a NOR circuit 75, an octave switching circuit 76, a set-reset type flip-flop 83, a delay flip-flop 84, an AND circuit 85, capacitors 95 and 96 and field-effect transistors 97 and 98, are similar in function to these similar numbered in FIG. 7.

Figure 11:
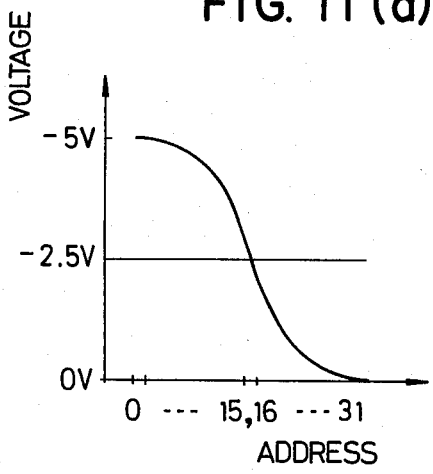
FIG. 11(*a*) is a graphical representation indicating a half period waveform of a sine wave (or cosine wave) which is stored in the waveform memory in FIG. 10 in advance.
Figure 11:
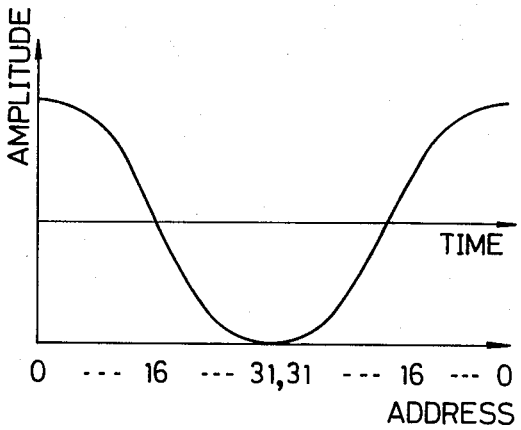

In a waveform memory 101, a half period waveform 32 of a sine wave as shown in FIG. 11(a) is divided at 32 sample points and are stored. A signal paralleling circuit 100 operates to (symmetrically) read the waveform thus stored by turning back through the memory. The waveform memory 101 comprises a waveform amplitude voltage generating circuit 102 and a waveform reading gate circuit 103. In the waveform reading gate circuit 103, similarly as in the gate circuit 94 in FIG. 7, no decoder is used, address signals (the outputs of the latch circuit 74) are directly inputted, and desired series gate groups are made conductive according to address signal combinations.

In the waveform amplitude voltage generating circuit 102, thirty-one resistors $r_1$ through $r_{31}$ are series-connected to divide a voltage between the capacitors 95 and 96 (that is, the voltage between −5 V and the ground in key depression) into 31 partial voltages, thereby to provide waveform amplitude voltage at thirty-two (32) sample points corresponding to thirty-two addresses 0 through 31. The values of the resistors $r_1$ through $r_{31}$ are so selected as to be able to approximate a half waveform of a sine waveform as shown in FIG. 11(a). That is, the central resistor $r_{16}$ is the highest in resistance, the resistors $r_{15}$ and $r_{17}$ are lower in resistance than the resistor $r_{16}$, and so forth. Finally, the terminal resistors $r_1$ and $r_{31}$ are the lowest. The resistance of these resistors are as $r_1=r_{31}$,—$r_i=r_{32-i}$—$r_{15}=r_{17}$. The central point of the central resistor $r_{16}$ is connected to the amplitude central voltage −2.5 V.

Reading one period waveform as shown in FIG. 11(b) can be accomplished first by reading a half of the waveform from the address 0 to the address 31 and then by reading it in the opposite direction, or from the address 31 to the address 0. In this case, one period waveform having sixty-four sample points can be read out. As the wave data $Q_2$–$Q_{10}$ used as the address specifying signal is a binary data, it cannot be used for the turn-back reading as in FIG. 11(b) without modifying it. Therefore, in this example, the binary frequency data $Q_2$–$Q_{10}$ is converted into a Gray code, which is used as the address specifying signal in the waveform memory 101. If, in an n-bit binary signal, adjacent bits are subjected to EXCLUSIVE OR logic operation, then a signal in the form of an (n−1)-bit Gray code can be obtained. As example of this is indicated in Table 3 with 6-bit binary signals.

TABLE 3

| | | binary | | | | | | Waveform Point No. | Gray code | | | | | | Address |
|---|---|---|---|---|---|---|---|---|---|---|---|---|---|---|---|
| ↑ | ↑ | 0 | 0 | 0 | 0 | 0 | 0 | 0 | 0 | 0 | 0 | 0 | 0 | 0 | 0 |
| ↑ | ↑ | 0 | 0 | 0 | 0 | 0 | 0 | 1 | 0 | 0 | 0 | 0 | 1 | | 1 |
| ↑ | ↑ | 0 | 0 | 0 | 0 | 1 | 0 | 2 | 0 | 0 | 0 | 1 | 1 | | 2 |
| ↑ | ↑ | 0 | 0 | 0 | 0 | 1 | 1 | 3 | 0 | 0 | 0 | 1 | 0 | | 3 |
| ↑ | ↑ | 0 | 0 | 0 | 1 | 0 | 0 | 4 | 0 | 0 | 1 | 1 | 0 | | 4 |
| ↑ | Half | 0 | 0 | 0 | 1 | 0 | 1 | 5 | 0 | 0 | 1 | 1 | 1 | | 5 |
| ↑ | period | 0 | 0 | 0 | 1 | 1 | 0 | 6 | 0 | 0 | 1 | 0 | 1 | | 6 |
| ↑ | | 0 | 0 | 0 | 1 | 1 | 1 | 7 | 0 | 0 | 1 | 0 | 0 | | 7 |
| ↑ | | 0 | 0 | 1 | 0 | 0 | 0 | 8 | 0 | 1 | 1 | 0 | 0 | | 8 |
| ↑ | | 0 | 0 | 1 | 0 | 0 | 1 | 9 | 0 | 1 | 1 | 0 | 1 | | 0 |
| | | 0 | 0 | 1 | 0 | 1 | 0 | 10 | 0 | 1 | 1 | 1 | 1 | | 10 |
| | | 0 | 0 | 1 | 0 | 1 | 1 | 11 | 0 | 1 | 1 | 1 | 0 | | 11 |
| | | 0 | 0 | 1 | 1 | 0 | 0 | 12 | 0 | 1 | 0 | 1 | 0 | | 12 |
| | | 0 | 0 | 1 | 1 | 0 | 1 | 13 | 0 | 1 | 0 | 1 | 1 | | 13 |
| | | 0 | 0 | 1 | 1 | 1 | 0 | 14 | 0 | 1 | 0 | 0 | 1 | | 14 |
| | | 0 | 0 | 1 | 1 | 1 | 1 | 15 | 0 | 1 | 0 | 0 | 0 | | 15 |
| | | 0 | 1 | 0 | 0 | 0 | 0 | 16 | 1 | 1 | 0 | 0 | 0 | | 16 |
| | | 0 | 1 | 0 | 0 | 0 | 1 | 17 | 1 | 1 | 0 | 0 | 1 | | 17 |
| | | 0 | 1 | 0 | 0 | 1 | 0 | 18 | 1 | 1 | 0 | 1 | 1 | | 18 |
| | | 0 | 1 | 0 | 0 | 1 | 1 | 19 | 1 | 1 | 0 | 1 | 0 | | 19 |
| one | | 0 | 1 | 0 | 1 | 0 | 0 | 20 | 1 | 1 | 1 | 1 | 0 | | 20 |
| period | | 0 | 1 | 0 | 1 | 0 | 1 | 21 | 1 | 1 | 1 | 1 | 1 | | 21 |
| ↓ | ↓ | 0 | 1 | 0 | 1 | 1 | 0 | 22 | 1 | 1 | 1 | 0 | 1 | | 22 |
| ↓ | ↓ | 0 | 1 | 0 | 1 | 1 | 1 | 23 | 1 | 1 | 1 | 0 | 0 | | 23 |
| ↓ | (first | 0 | 1 | 1 | 0 | 0 | 0 | 24 | 1 | 0 | 1 | 0 | 0 | | 24 |
| ↓ | half) | 0 | 1 | 1 | 0 | 0 | 1 | 25 | 1 | 0 | 1 | 0 | 1 | | 25 |
| ↓ | ↓ | 0 | 1 | 1 | 0 | 1 | 0 | 26 | 1 | 0 | 1 | 1 | 1 | | 26 |
| ↓ | ↓ | 0 | 1 | 1 | 0 | 1 | 1 | 27 | 1 | 0 | 1 | 1 | 0 | | 27 |
| ↓ | ↓ | 0 | 1 | 1 | 1 | 0 | 0 | 28 | 1 | 0 | 0 | 1 | 0 | | 28 |
| ↓ | ↓ | 0 | 1 | 1 | 1 | 0 | 1 | 29 | 1 | 0 | 0 | 1 | 1 | | 29 |
| ↓ | ↓ | 0 | 1 | 1 | 1 | 1 | 0 | 30 | 1 | 0 | 0 | 0 | 1 | | 30 |
| ↓ | ↑ | 0 | 1 | 1 | 1 | 1 | 1 | 31 | 1 | 0 | 0 | 0 | 0 | | 31 |
| ↓ | ↑ | 1 | 0 | 0 | 0 | 0 | 0 | 32 | 1 | 0 | 0 | 0 | 0 | | 32 |
| ↓ | ↑ | 1 | 0 | 0 | 0 | 0 | 0 | 33 | 1 | 0 | 0 | 0 | 1 | | 30 |
| ↓ | ↑ | 1 | 0 | 0 | 0 | 1 | 0 | 34 | 1 | 0 | 0 | 1 | 1 | | 29 |
| ↓ | ↑ | 1 | 0 | 0 | 0 | 1 | 1 | 35 | 1 | 0 | 0 | 1 | 0 | | 28 |
| ↓ | ↑ | 1 | 0 | 0 | 1 | 0 | 0 | 36 | 1 | 0 | 1 | 1 | 0 | | 27 |
| ↓ | ↑ | 1 | 0 | 0 | 1 | 0 | 1 | 37 | 1 | 0 | 1 | 1 | 1 | | 26 |
| ↓ | ↑ | 1 | 0 | 0 | 1 | 1 | 0 | 38 | 1 | 0 | 1 | 0 | 1 | | 25 |
| ↓ | ↑ | 1 | 0 | 0 | 1 | 1 | 1 | 39 | 1 | 0 | 1 | 0 | 0 | | 24 |
| ↓ | half | 1 | 0 | 1 | 0 | 0 | 0 | 40 | 1 | 1 | 1 | 0 | 0 | | 23 |
| ↓ | period | 1 | 0 | 1 | 0 | 0 | 1 | 41 | 1 | 1 | 1 | 0 | 1 | | 22 |
| ↓ | | 1 | 0 | 1 | 0 | 1 | 0 | 42 | 1 | 1 | 1 | 1 | 1 | | 21 |
| ↓ | | 1 | 0 | 1 | 0 | 1 | 1 | 43 | 1 | 1 | 1 | 1 | 0 | | 20 |
| ↓ | | 1 | 0 | 1 | 1 | 0 | 0 | 44 | 1 | 1 | 0 | 1 | 0 | | 19 |
| ↓ | | 1 | 0 | 1 | 1 | 0 | 1 | 45 | 1 | 1 | 0 | 1 | 1 | | 18 |
| ↓ | | 1 | 0 | 1 | 1 | 1 | 0 | 46 | 1 | 1 | 0 | 0 | 1 | | 17 |
| ↓ | | 1 | 0 | 1 | 1 | 1 | 1 | 47 | 1 | 1 | 0 | 0 | 0 | | 16 |
| ↓ | | 1 | 1 | 0 | 0 | 0 | 0 | 48 | 0 | 1 | 0 | 0 | 0 | | 15 |
| ↓ | | 1 | 1 | 0 | 0 | 0 | 1 | 49 | 0 | 1 | 0 | 0 | 1 | | 14 |
| ↓ | | 1 | 1 | 0 | 0 | 1 | 0 | 50 | 0 | 1 | 0 | 1 | 1 | | 13 |
| ↓ | | 1 | 1 | 0 | 0 | 1 | 1 | 51 | 0 | 1 | 0 | 1 | 0 | | 12 |
| ↓ | | 1 | 1 | 0 | 1 | 0 | 0 | 52 | 0 | 1 | 1 | 1 | 0 | | 11 |
| ↓ | (second | 1 | 1 | 0 | 1 | 0 | 1 | 53 | 0 | 1 | 1 | 1 | 1 | | 10 |
| ↓ | half) | 1 | 1 | 0 | 1 | 1 | 0 | 54 | 0 | 1 | 1 | 0 | 1 | | 9 |
| ↓ | ↓ | 1 | 1 | 0 | 1 | 1 | 1 | 55 | 0 | 1 | 1 | 0 | 0 | | 8 |
| ↓ | ↓ | 1 | 1 | 1 | 0 | 0 | 0 | 56 | 0 | 0 | 1 | 0 | 0 | | 7 |
| ↓ | ↓ | 1 | 1 | 1 | 0 | 0 | 1 | 57 | 0 | 0 | 1 | 0 | 1 | | 6 |
| ↓ | ↓ | 1 | 1 | 1 | 0 | 1 | 0 | 58 | 0 | 0 | 1 | 1 | 1 | | 5 |
| ↓ | ↓ | 1 | 1 | 1 | 0 | 1 | 1 | 59 | 0 | 0 | 1 | 1 | 0 | | 4 |
| ↓ | ↓ | 1 | 1 | 1 | 1 | 0 | 0 | 60 | 0 | 0 | 0 | 1 | 0 | | 3 |
| ↓ | ↓ | 1 | 1 | 1 | 1 | 0 | 1 | 61 | 0 | 0 | 0 | 1 | 1 | | 2 |
| ↓ | ↓ | 1 | 1 | 1 | 1 | 1 | 0 | 62 | 0 | 0 | 0 | 0 | 1 | | 1 |
| ↓ | ↓ | 1 | 1 | 1 | 1 | 1 | 1 | 63 | 0 | 0 | 0 | 0 | 0 | | 0 |

As is apparent from Table 3, while the 6-bit binary signal increases successively from the minimum value (0 0 0 0 0 0) to the maximum value (1 1 1 1 1 1), the 5-bit Gray code signal experiences the same data twice. More specifically, if it is assumed that the 5-bit Gray code signals (0 0 0 0 0–1 0 0 0 0) corresponds to the addresses 0 through 31, respectively, while the binary signal is changed from "0 0 0 0 0 0" to "0 1 1 1 1 1" (31 in decimal notation) the Gray code signal is changed from the address 0 to the address 31, but while the binary signal is increased from "1 0 0 0 0 0" (32 in decimal notation) to "1 1 1 1 1 1" (63 in decimal notation), the Gray code signal is changed in the opposite direction from the address 31 to the address 0 (turning back). Accordingly, the half waveform stored in the addresses 0 through 31 of the waveform 101 can be read in a turn-back mode (symmetrically) with address specifying signals of modulo N/2 (32 for instance) obtained by Gray-coding binary signals of modulo N (64 for instance).

The advantage that the address specifying signals converted into Gray codes are employed in the case where the half waveform stored in the waveform memory 101 is symmetrically read out in a turn-back mode to provide a symmetrical waveform of one period resides in that switching the frequency of a waveform read out of the waveform memory 101 can be accomplished merely by shifting the bit position of the Gray code signal. In the Gray code, data of a bit less in significance than a given bit by one digit repeats variation of the contents thereof twice as frequently as variation of data including the given bit. Accordingly, by shifting left a Gray code type address signal, a turn-back waveform (symmetrical waveform) having a frequency two times, four times—as high can be read out according to the amount of shifting.

In the example shown in FIG. 10, the multiplexed wave data $Q_2$–$Q_{10}$ supplied through the line 31 are converted into Gray codes before being applied to the shift register 73. A delay flip-flop 105 for delaying by one bit time the wave data P, $Q_2$–$Q_{10}$ on the line 31, and an EXCLUSIVE OR circuit 104 for receiving the output of the delay flip-flop 105 and the wave data P, $Q_2$–$Q_{10}$ are provided for converting the binary signals in a series mode into Gray codes. This Gray-coding operation in a series mode will be described with reference to FIG. 12.

The part (a) of FIG. 12 shows the generation of the wave data P, $Q_2$–$Q_{10}$; the part (b) shows the output of the delay flip-flop 105 obtained by delaying the wave data P, $Q_2$–$Q_{12}$ by one bit time; and the part (c) shows the output of the EXCLUSIVE OR circuit 104 receiving the signals shown in the parts (a) and (b). The output of the EXCLUSIVE OR circuit 104 is inputted into the shift register 73. Since no data is provided before the reference timing signal P as described before, the output of the EXCLUSIVE OR circuit 104 is maintained at "0" until the arrival of the reference timing signal P. When the reference timing pulse P (at the signal level "1") is supplied to the line at the timing $t_0'$, the output of the delay flip-flop 105. is at "0" which is the data 1 bit time before the supply of the pulse P. Therefore the output of the EXCLUSIVE OR circuit 104 is set to "1", and the signal "1" representative of the reference timing pulse P is supplied to the shift register 73.

At the next timing $t_1'$, the data $Q_2$ is supplied to the EXCLUSIVE OR circuit 104 through the line 31, and the delay flip-flop 105 applies the signal "1" obtained by delaying the reference timing pulse P to the EXCLUSIVE OR circuit 104. The EXCLUSIVE OR logic output of the data $Q_2$ and the signal "1" is a signal $\overline{Q_2}$ obtained by inverting the data $Q_2$.

The wave data $Q_2$–$Q_{10}$ (that is, the 9-bit binary signal) is converted into a Gray code during the period of from the timing $t_2'$ to the timing $t_9'$. In other words, a one-bit-time earlier data is inputted to the EXCLUSIVE OR circuit 104 from the delay flip-flop 105, and therefore the EXCLUSIVE OR logic output of adjacent bits is obtained in this EXCLUSIVE OR circuit 104. The EXCLUSIVE OR logic output of the data $Q_2$ and $Q_3$ will be designated by $Q_2$*. Similarly, in the part (c) of FIG. 12, the data $Q_2$* through $Q_9$* (with the symbol "*") are the EXCLUSIVE OR logic outputs of adjacent bits in the binary number.

At the timing $t_{10}'$, the signal on the line 31 is set to "0", and the last data $Q_{10}$ is outputted by the delay flip-flop 105. In this case, the output of the EXCLUSIVE OR circuit is the data $Q_{10}$; however, this is an unnecessary signal.

In the manner as described above, the Gray-coded signals $Q_2$*–$Q_9$* are inputted into the shift register 73. The control in the case where the signals $\overline{Q_2}$ and $Q_2$*–$Q_9$* paralleled by the shift register 73 are latched by the latch circuit 74 is similar to that in the case of FIG. 7. For instance in the case where the fifth octave signal $OC_5$ is at "1", the strobe pulse SP is applied to the latch circuit 74 when the reference timing pulse P is applied to the stage $S_7$ in the shift register 73. In this case, the signal $\overline{Q_2}$ has been inputted into the stage $S_6$ of the shift register 73 and the signals $Q_5$*, $Q_4$*, $Q_3$* and $Q_2$* have been inputted into the stages $S_2$ through $S_5$ of the shift register 73, respectively. Therefore, the signals $Q_5$*–$Q_2$* and $\overline{Q_2}$ are latched in the latch positions $L_8$–$L_4$ of the latch circuit 74, the latch contents of the latch positions $L_3$–$L_1$ being all at "0". As shown in the part (c) of FIG. 12, the unnecessary data $Q_{10}$ is inputted into the shift register 73 after the data $Q_9$* has been inputted. This unnecessary data $Q_{10}$ is inputted into the first stage $S_1$ when the reference timing pulse P is inputted into the last stage $S_{11}$. Thus, the data $Q_{10}$ will never be latched by the latch circuit 74.

Similarly as in the case of FIG. 7, the latch timing of the latch circuit 74 is controlled by the octave switching circuit 76. Therefore, the positions of the Gray-coded signals $\overline{Q_2}$ and $Q_2$*–$Q_9$*, which are latched by the latch circuit 74, are shifted by one bit according to the octave ranges. This will become more apparent when referred to the following Table 4;

TABLE 4

| | Latch Position | | | | | | | |
|---|---|---|---|---|---|---|---|---|
| Octave | $L_8$ | $L_7$ | $L_6$ | $L_5$ | $L_4$ | $L_3$ | $L_2$ | $L_1$ |
| First octave ($OC_1$) | $Q_9$* | $Q_8$* | $Q_7$* | $Q_6$ | $Q_5$ | $Q_4$ | $Q_3$ | $Q_2$ |
| Second octave ($OC_2$) | $Q_8$* | $Q_7$ | $Q_6$ | $Q_5$ | $Q_4$ | $Q_3$ | $Q_2$ | $\overline{Q_2}$ |
| Third octave ($OC_3$) | $Q_7$* | $Q_6$ | $Q_5$ | $Q_4$ | $Q_3$ | $Q_2$ | $\overline{Q_2}$ | 0 |
| Fourth octave ($OC_4$) | $Q_6$* | $Q_5$ | $Q_4$ | $Q_3$ | $Q_2$ | $\overline{Q_2}$ | 0 | 0 |
| Fifth octave ($OC_5$) | $Q_5$* | $Q_4$ | $Q_3$ | $Q_2$ | $\overline{Q_2}$ | 0 | 0 | 0 |

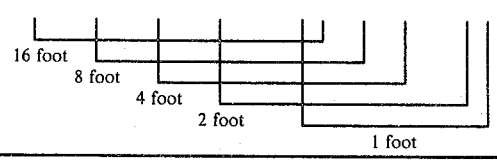

In the waveform reading gate circuit 103, the series gate group provided respectively for the addresses for reading a waveform for 16-foot register (16') are connected between a line M16' and amplitude voltage leading points provided respectively for the addresses. The outputs of series gate groups provided for reading waveform for 8-foot register (8') are connected to a line M8'. Similarly, the output of series gates groups provided for reading waveforms for 4-foot register (4'), for 2-foot register (2') and for 1-foot register (1') are connected to lines M4', M2' and M1', respectively. In the waveform reading gate 103, a predetermined output ($L_8$–$L_1$, or $L_8$–$L_1$) of the latch circuit 74 is applied to the gate electrodes of five (or four) field-effect transistors forming a series gate group, so that when a 5-bit (or 4-bit) Gray code signal has contents corresponding its address, the field-effect transistors renders conductive between the voltage leading point and the respective line (M16'–M1'). The outputs $\overline{L_1}$ through $\overline{L_8}$ of the latch circuit 74 are obtained by inverting the outputs of the latch positions $L_1$ through $L_8$.

In order to read the waveform for 16-foot register, the 5-bit Gray code signal latched.in the latch positions $L_4$–$L_8$ of the latch circuit 74 is used. The signal latched in the latch positions $L_3$–$L_7$ is used to read the waveform for 8-foot register. Similarly, as is apparent from FIG. 10 and Table 4, the signals latched in the latch positions $L_2$–$L_6$, $L_1$–$L_5$ and $L_1$–$L_4$ are used to read the waveforms for 4-foot (4'), 2-foot (2') and 1-foot (1') registers, respectively.

In all of the 5-bit Gray code is used as the reading address specifying signal, the number of steps of one waveform read out will be sixty-four (64). However, in the case where the Gray code is of 4-bits, the number (quantity) of steps is 32; in the case where the Gray code is of 3-bits, the number of steps is 16; in the case where the Gray code is of 2-bits, the number of steps is 8; and in the case where the Gray code is of 1-bit, the number of steps is 4. The number of steps of the read waveforms of the octave ranges in the respective footage registers (16', 8', 4', 2' and 1') can be readily understood from Table 4. The number of steps of the read waveforms separately according to the footage registers and the octave ranges are indicated in Table 5 below:

TABLE 5

| | Footage | | | | |
|---|---|---|---|---|---|
| Octave | 16' | 8' | 4' | 2' | 1' |
| 1 ($OC_1$) | 64 | 64 | 64 | 64 | 32 |
| 2 ($OC_2$) | 64 | 64 | 64 | 32 | 16 |
| 3 ($OC_3$) | 64 | 64 | 32 | 16 | 8 |
| 4 ($OC_4$) | 64 | 32 | 16 | 8 | 4 |
| 5 ($OC_5$) | 32 | 16 | 8 | 4 | 0 |

As is clear from Table 4, in the case of the second through fifth octaves ($OC_2$–$OC_5$) the signal $\overline{Q_2}$ is inputted into the latch circuit 74. This signal $\overline{Q_2}$ is used as a part of the address signal with respect to the 1-foot register (1') and 2-foot register (2') in the second octave, the 4-foot register (4'), 2-foot register (2') and 1-foot register (1') in the third octave, the 8-foot register (8'), 4-foot register (4'), 2-foot register (2') and 1-foot register (1') in the fourth octave, and all the footage registers (16' through 1') in the fifth octave. This signal $\overline{Q_2}$ is necessary to correctly read the waveforms (sine waves) stored in the waveform memory 101 although it is not included in the regular Gray code $Q_2$*–$Q_9$*.

This will be concretely described. For instance, in the case of the 2-foot register (2') of the second octave ($OC_2$), the output signal of the latch positions $L_5$–$L_1$ is used as the address signal. If in this case the signal $\overline{Q_2}$ is not used and instead the position $L_1$ corresponding to the signal $Q_2$ is fixed to L=0, then the contents of the latch positions $L_5$–$L_1$ is changed as indicated in Table 6 below. Therefore, if the output signal of the latch positions $L_5$–$L_1$ is used as the Gray code type address signal, then addressing the waveform memory will be advanced at irregular intervals 0, 3, 4, 7, 8, 11, 12—as is apparent from Table 3. Accordingly, it is impossible to correctly read the waveforms out of the waveform memory 101. On the other hand, if the signal $\overline{Q_2}$ is used with $L_1=\overline{Q_2}$ as in this example, the contents of the latch positions $L_5$–$L_1$ is changed as indicated in Table 7 below; that is, addressing the waveform 101 is advanced at equal intervals 1, 3, 5, 7, 9, 11—. Accordingly, it is possible to correctly read the waveform out of the waveform memory 101.

TABLE 6

$L_1 = 0 (\neq \overline{Q_2})$

| $L_5$ | $L_4$ | $L_3$ | $L_2$ | $L_1$ | address |
|---|---|---|---|---|---|
| 0 | 0 | 0 | 0 | 0 | 0 |
| 0 | 0 | 0 | 1 | 0 | 3 |
| 0 | 0 | 1 | 1 | 0 | 4 |
| 0 | 0 | 1 | 0 | 0 | 7 |
| 0 | 1 | 1 | 0 | 0 | 8 |
| 0 | 1 | 1 | 1 | 0 | 11 |
| 0 | 1 | 0 | 1 | 0 | 12 |
| 0 | 1 | 0 | 0 | 0 | 15 |
| 1 | 1 | 0 | 0 | 0 | 16 |
| 1 | 1 | 0 | 1 | 0 | 19 |
| 1 | 1 | 1 | 1 | 0 | 20 |
| 1 | 1 | 1 | 0 | 0 | 23 |
| 1 | 0 | 1 | 0 | 0 | 24 |
| 1 | 0 | 1 | 1 | 0 | 27 |
| 1 | 0 | 0 | 1 | 0 | 28 |
| 1 | 0 | 0 | 0 | 0 | 31 |
| 1 | 0 | 0 | 0 | 0 | 31 |
| 1 | 0 | 0 | 1 | 0 | 28 |
| 1 | 0 | 1 | 1 | 0 | 27 |
| 1 | 0 | 1 | 0 | 0 | 24 |
| 1 | 1 | 1 | 0 | 0 | 23 |
| 1 | 1 | 1 | 1 | 0 | 20 |
| 1 | 1 | 0 | 1 | 0 | 19 |
| 1 | 1 | 0 | 0 | 0 | 16 |
| 0 | 1 | 0 | 0 | 0 | 15 |
| 0 | 1 | 0 | 1 | 0 | 12 |
| 0 | 1 | 1 | 1 | 0 | 11 |
| 0 | 1 | 1 | 0 | 0 | 8 |
| 0 | 0 | 1 | 0 | 0 | 7 |
| 0 | 0 | 1 | 1 | 0 | 4 |
| 0 | 0 | 0 | 1 | 0 | 3 |
| 0 | 0 | 0 | 0 | 0 | 0 |

TABLE 7

$L_1 = \overline{Q_2}$

| $L_5$ | $L_4$ | $L_3$ | $L_2$ | $Q_2$ $L_1$ | address |
|---|---|---|---|---|---|
| 0 | 0 | 0 | 0 | 1 | 1 |
| 0 | 0 | 0 | 1 | 0 | 3 |
| 0 | 0 | 1 | 1 | 1 | 5 |
| 0 | 0 | 1 | 0 | 0 | 7 |
| 0 | 1 | 1 | 0 | 1 | 9 |
| 0 | 1 | 1 | 1 | 0 | 11 |
| 0 | 1 | 0 | 1 | 1 | 13 |
| 0 | 1 | 0 | 0 | 0 | 15 |
| 1 | 1 | 0 | 0 | 1 | 17 |
| 1 | 1 | 0 | 1 | 0 | 19 |
| 1 | 1 | 1 | 1 | 1 | 21 |
| 1 | 1 | 1 | 0 | 0 | 23 |
| 1 | 0 | 1 | 0 | 1 | 25 |
| 1 | 0 | 1 | 1 | 0 | 27 |
| 1 | 0 | 0 | 1 | 1 | 29 |
| 1 | 0 | 0 | 0 | 0 | 31 |
| 1 | 0 | 0 | 0 | 1 | 30 |
| 1 | 0 | 0 | 1 | 0 | 28 |
| 1 | 0 | 1 | 1 | 1 | 26 |

TABLE 7-continued

| $L_1 = \overline{Q_2}$ | | | | | |
|---|---|---|---|---|---|
| $L_5$ | $L_4$ | $L_3$ | $L_2$ | $Q_2$ $L_1$ | address |
| 1 | 0 | 1 | 0 | 0 | 24 |
| 1 | 1 | 1 | 0 | 1 | 22 |
| 1 | 1 | 1 | 1 | 0 | 20 |
| 1 | 1 | 0 | 1 | 1 | 18 |
| 1 | 1 | 0 | 0 | 0 | 16 |
| 0 | 1 | 0 | 0 | 1 | 14 |
| 0 | 1 | 0 | 1 | 0 | 12 |
| 0 | 1 | 1 | 1 | 1 | 10 |
| 0 | 1 | 1 | 0 | 0 | 8 |
| 0 | 0 | 1 | 0 | 1 | 6 |
| 0 | 0 | 1 | 1 | 0 | 4 |
| 0 | 0 | 0 | 1 | 1 | 2 |
| 0 | 0 | 0 | 0 | 0 | 0 |

(4) Modification of the Gray-coding Circuit

FIG. 13 shows on example of a modification of the circuit for converting the wave data $Q_2$–$Q_{10}$ into a Gray code signal. More specifically, FIG. 13 shows only a signal paralleling circuit 100'. However, it should be noted that a waveform memory is similar to the waveform memory 101 shown in FIG. 10. The circuit 100' in FIG. 13 is different from that in FIG. 10 in that gates (field-effect transistors) 107 and 108 are provided in the section formed with the EXCLUSIVE OR circuit 104 and the delay flip-flop 105 for converting the multiplexed octavelyrelated wave data $Q_2$–$Q_{10}$ into a Gray code, and the number of stages in a shift register 73' (corresponding to the shift register 73 in FIG. 3) for paralleling signals is ten (10).

The frequency data P, $Q_2$–$Q_{10}$ is applied through the line 31 to the gate 107, and the Gray-coded signal $Q_2^*$–$Q_9^*$ is applied from the EXCLUSIVE OR circuit 104 to the gate 108. Strictly stating, the data train shown in the part (a) of FIG. 12 is applied to the gate 107, and the data train P("1"), $\overline{Q_2}$, $Q_2^*$–$Q_9^*$, $Q_{10}$ indicated in the part (c) of FIG. 12 is applied to the gate 108. The output signal of the flip-flop 83 is applied directly to the gate control electrode of the gate 108, and it is applied through an inverter 109 to the gate control electrode of the gate 107. Accordingly, the gate 107 and 108 are not simultaneously rendered conductive; that is, they are alternately rendered conductive according to the level ("1" or "0") of the output signal of the flip-flop 83. The output signal of the flip-flop 83 is as indicated in the part (d) of FIG. 12. Since the timing of resetting this flip-flop 83 depends on the octave ranges, the time width of the signal "1" shown in the part (d) of FIG. 12 depends on the octave ranges ($OC_5$ through $OC_1$). When the first octave signal $OC_1$ is at "1", it has the longest time width of from the timing $t_1'$ to the timing $t_{9'}$.

When the reference timing pulse P at the top of the wave data P, $Q_2$–$Q_{10}$ appears on the line 31 (at the timing $t_0'$ in FIG. 12), the output of the flip-flop 83 is at "0", and therefore the gate 107 is conductive. As a result, the reference timing pulse P is inputted into the first stage $S_1$ of the shift register 73' through the gate 107. When the reference timing pulse P is outputted by the first stage $S_1$ at the timing $t_1'$ (the inverted output $S_1$ being at "0") the condition of the NOR circuit 75 is satisfied, and the flip-flop 83 is therefore set. As a result, the output of the flip-flop 83 is raised to "1" at the timing $t_1'$, whereby the gate 107 is rendered non-conductive, while the gate 108 is rendered conductive. Accordingly, the data $\overline{Q_2}$ outputted by the EXCLUSIVE OR circuit 104 at the timing $t_1'$ (cf. FIG. 12, (c)) is inputted into the shift register 73', and it is outputted by the first stage $S_1$ thereof at the timing $t_2'$. Thereafter, the gate 108 is maintained conductive immediately before the strobe pulse SP' is supplied from the AND circuit 85 to the latch circuit 74, and therefore the output (Graycoded signal $\overline{Q_2}$, $Q_2^*$–$Q_9^*$) of the EXCLUSIVE OR circuit is successively inputted into the shift register 73'.

In the case where the first octave signal $OC_1$ is at "1" the gate 108 is conductive for the longest period of time. This case will be described in more detail. When the reference timing pulse P is inputted into the last stage $S_{10}$ of the shift register 73', the AND circuit 81 is operated so that the flip-flop 83 is reset. This occurs at the timing $t_{10}'$ in FIG. 12. At this timeing, the data $\overline{Q_2}$, $Q_2^*$, $Q_3^*$, $Q_4^*$, $Q_5^*$, $Q_6^*$, $Q_7^*$, $Q_8^*$ and $Q_9^*$ have been inputted into the stages $S_9$ through $S_1$ of the shift register 73', the data $Q_{10}$ is outputted by the EXCLUSIVE OR circuit 104 (cf. FIG. 12, (c)), and the data on the line 31 is at "0" (cf. FIG. 12 (a)). As the flip-flop 83 is reset as described above, the output of the flip-flop 83 is reset as described above, the output of the flip-flop 83 is lowered to '0" immediately at the timing $t_{10}$, (cf. FIG. 12 (d)). As a result, the gate 108 is rendered non-conductive, while the gate 107 is rendered conductive, and therefore the signal "0" on the line 31 is applied to the shift register 73'. At this timing $t_{10}'$, the strobe pulse SP' is produced, and the data $Q_2^*$, $Q_3^*$, $Q_4^*$, $Q_5^*$, $Q_7^*$, $Q_8^*$ and $Q_9^*$ held in the stages $S_8$ through $S_1$ of the shift register 73' are inputted into the latch positions $L_1$ through $L_8$ of the latch circuit 74, respectively. At the next timing $t_{11}'$, the data $Q_9^*$ in the first stage $S_1$ of the shift register 73' is shifted into the second stage $S_2$, the data $Q_8^*$ through $Q_2$ and $\overline{Q_2}$ in the stages $S_2$ through $S_9$ are shifted into the third stage $S_3$ through thelast stage $S_{10}$, respectively, and the data P in the last stage $S_{10}$ is delivered out of the shift register 73' (or it is carried out). At the same time, the signal "0" having been applied to the first stage through the gate 107 at the preceding timing $t_{10}'$ is inputted into the first stage $S_1$ (outputted from the first stage $S_1$).

As is apparent from the above description, immediately after the gate 108 has selected the last data $Q_9^*$ of the Gray code signal, the operation is switched over to the gate 107, and therefore the unnecessary data $Q_{10}$ (cf. FIG. 12, (c)) outputted by the EXCLUSIVE OR circuit 104 in succession with the data $Q_9^*$ is blocked by the gate 108. Accordingly, when the reference timing pulse P is carried out of the tenth stage $S_{10}$ of the shift register 73', the signal "0" is inputted into the first stage $S_1$ positively. In other words, when the data $\overline{Q_2}$ and $Q_2^*$–$Q_9^*$ which can be raised to "1" are inputted into the first stage $S_1$, the reference timing pulse P ("1") is inputted positively into one of the stages $S_2$ through $S_{10}$. Accordingly, only when the reference timing pulse P is inputted into the first stage $S_1$, the condition of the NOR circuit 75 is satisfied; that is, when the other data $\overline{Q_2}$ and $Q_2^*$–$Q_9^*$ are inputted into the first stage $S_1$, the condition of the NOR circuit 75 is not satisfied. Thus, with the circuit shown in FIG. 13, even if the number of stages in the shift register 73 is only ten, the strobe pulse SP' is correctly produced, and accordingly, the latch circuit 74 carries out its latch operation correctly.

On the other hand, if the number of stages in the shift register 73 in FIG. 10 is reduced to ten (10), then the reference timing pulse P is carried out of the tenth stage $S_{10}$ when the data $Q_{10}$ (the last data) next to the data $Q_9^*$ is inputted into the first stage $S_1$. Accordingly, in the case where all of the data $\overline{Q_2}$ and $Q_2^*$–$Q_9^*$ are at "0" and only the data $Q_{10}$ is at "1", the condition of the NOR circuit 75 is satisfied, as a result of which the strobe pulse SP' is thereafter incorrectly produced, and therefore, the latch operation is incorrectly carried out. Thus, in the case of the circuit shown in FIG. 10, the number of stages in the shift register 73 should be at least eleven (11).

In the above description, the binary wave data $Q_2$–$Q_{10}$ is, in the form of a series signal, converted into the Gray code; however, the invention is not limited thereto or thereby. That is, after being latched in a parallel mode, the binary wave data $Q_2$–$Q_{10}$ may be converted, in a parallel mode, into the Gray code. Furthermore, in the the example shown in FIG. 1, after being multiplexed in time division manner in the data multiplexing circuit 13, the key code, etc. outputted by the channel assignment circuit 12 are arranged into parallel signals by the tone generator section 15 and are utilized in the tone generators of the channels; however such process is not always required; that is, the outputs of the channel assignment circuit 12 may be distributed to the tone generators.

In the example described above, the operation of setting and switching the bit positions of the wave data $Q_2$–$Q_{10}$ (or $Q_2^*$–$Q_{10}^*$) according to the octave ranges is carried out by dynamically controlling the latch timing of the latch circuit 74 in cooperation of the octave switching circuit 76 and the AND circuit 85; however, the invention is not limited thereto or thereby; that is, the relevant circuit may be so designed that the latch timing is maintained unchanged irrespective of the octave ranges, and a gate means for shifting the bit positions in a parallel mode is provided between the shift register 73 and the latch circuit 74 so that the octave are set up by a static bit position shifting operation. Furthermore, the electronic musical instrument according to this invention has been described with reference to the case where the sinusoidal waveforms and the saw tooth waveforms are stored inthe waveform memories 72 and 101 in the tone waveform generating sections 32 and 33, respectively. However, it goes without saying that the waveform memories 72 and 101 may store other waveforms.

What is claimed is:

1. An electronic musical instrument comprising:

a synchronous binary counter which divides the frequency of an input basic pulse train occurring at a rate corresponding to an allotted note of the musical scale, the resultant divided binary contents of said counter being supplied serially as an output upon occurrence of successive basic pulses, a memory storing sampled amplitudes of a waveform, and readout means, connected to said counter to receive said serially supplied binary contents and cooperating with said memory, for reading out a sampled amplitude from said memory each time that said contents are supplied, utilizing a selected subset of said supplied binary contents as the memory address for such readout, thereby to produce a waveform having the frequency of said allotted note in an octave established by the particular selected subset of contents.

2. An electronic musical instrument according to claim 1 wherein said readout means comprises:

a shift register having a plurality of stages, said supplied binary contents being serially shifted into said shift register, a latch, the contents of said latch establishing said memory address for readout, a transfer circuit, interconnecting a designated set of said shift register stages to said latch, and operative to transfer data from said set of stages to said latch when said selected subset of supplied contents has been shifted into said designated set of register stages.

3. An electronic musical instrument comprising:

a synchronous binary counter which divides the frequency of a basic pulse train occurring at a rate corresponding to an allotted note of the musical scale, supply means for supplying the binary contents of said counter serially upon occurrence of successive basic pulses, a memory storing sampled amplitude of a waveform, and readout means, connected to said supply means to receive said serially supplied binary contents and cooperating with said memory, for reading out a sampled amplitude from said memory each time that said contents are supplied, utilizing a selected subset of said supplied binary contents as the memory address for such readout, thereby to produce a waveform having the frequency of said allotted note in an octave established by the particular selected subset of contents.

4. An electronic musical instrument according to claim 3 wherein said readout means comprises:

a shift register having a plurality of stages, said supplied binary contents being serially shifted into said shift register, a latch, the contents of said latch establishing said memory address for readout, a transfer circuit, interconnecting a designated set of said shift register stages to said latch, and operative to transfer data from said set of stages to said latch when said selected subset of supplied contents has been shifted into said designated set of register stages.

5. An electronic musical instrument according to claim 4 including means for providing to said transfer circuit an octave selection signal which designates the set of register stages from which data is transferred to said latch.

6. An electronic musical instrument according to claim 5 and including a note selection keyboard and a plurality of said synchronous binary counters and associated supply means each having a basic pulse train corresponding to a respective different note of the musical scale, the serially supplied contents from all of said counters being provided to a note selection circuit which passes to said readout means only the supplied contents of the counter having a pulse train corresponding to a single note selected by a depressed keyboard key, said depressed key also establishing said octave selection signal.

7. An electronic musical instrument according to claim 3 wherein said memory stores sampled amplitudes of half of a symmetric waveform, and wherein adjacent bits of said supplied contents are exclusively-ORed together, said readout means utilizing a selected subset of said exclusively-ORed together contents as the memory address for readout, thereby resulting in consecutive forward and backward readout of said memory to produce a full symmetric waveform.

8. An electronic musical instrument comprising:

a multiplexed wave data generator means for producing a repetitive, binary coded wave data signal having a repetition rate corresponding to a particular note of the musical scale, said wave data signal being incremented at successive repetitions, a waveform memory storing amplitude samples of a waveform at consecutive sample points, a latch having a plurality of stages and means for entering said binary coded wave data signal into particular stages of said latch upon each repetition thereof, said particular stages being selected in accordance with an octave selection signal, and readout means for reading out said amplitude samples from said memory utilizing the data in certain stages of said latch as a memory access address, whereby said read out amplitude samples constitute a waveform having the frequency of said particular note in an octave established by said octave selection signal.

9. An electronic musical instrument according to claim 8 wherein said wave data generator means comprises:

a digital oscillator providing a train of pulses at said repetition rate corresponding to said particular note, a binary counter incremented by said pulses, and transmission means for transmitting in serial format, upon each occurrence of said pulse itself, both said pulse and the contents of a certain portion of said counter, said transmitted contents corresponding to said wave data signal, the time duration for transmitting said wave data signal being short in comparison with said repetition rate.

10. An electronic musical instrument according to claim 9 wherein said means for latching comprises:

a shift register having a plurality of consecutive stages and being connected to said transmission means so as to receive and serially shift said transmitted pulse and binary coded wave data signal through consecutive stages of said register, detection circuitry, cooperatively connected to said shift register, to detect the location of said transmitted pulse in said shift register during said serial shifting therethrough, coupling circuit, interconnecting stages of said shift register to stages of said latch and cooperating with said detection circuitry, for transferring at least part of said received binary coded wave data signal from said shift register to said latch when said transmitted pulse is at a certain location in said shift register, said certain location being specified by said octave selection signal.

11. An electronic musical instrument according to claim 10 wherein said latch has at least a certain number of consecutive stages, wherein said transferred part of said received binary coded wave data signal includes n consecutive bits from the transmitted contents of said binary counter, and wherein said readout means includes a binary decoder gate circuit connected to access waveform amplitude samples from waveform memory addresses having consecutive binary values, said decoder gate circuit being connected to said at least n consecutive stages so as to access from said waveform memory the amplitude sample at the address specified by the binary value of the contents of said at least n consecutive stages.

12. An electronic musical instrument according to claim 11 wherein said coupling circuitry interconnects a certain subset of consecutive shift register stages to said at least n consecutive latch stages, so that as said binary coded wave data signal is being shifted through said register, said subset of register stages will contain binary bits of differing order, whereby the data transferred to said latch will have a relative binary magnitude established by said octave selection signal, the rate of change between binary "1" and "0" of the data bit in the lowest order one of said n consecutive latch stages thereby being established by said octave selection signal so as to cause readout of a waveform having said selected octave.

13. A keyboard electronic musical instrument comprising:

(a) a plurality of multiplexed octavely-related wave data generator means, each allotted to a respective different musical note, and each for generating a time division multiplexed, octave-related wave data signal having a reference pulse frequency corresponding to the frequency of the respective allotted note and including a plurality of data bits exhibiting timewise changes in binary relations thereby representing states of octavely-related waves for the allotted note;

(b) a note selection circuit means, connected to said plural data generator means to receive the respective data signals therefrom, for selecting the one of said received octavely-related wave data signals corresponding to a note specified by a depressed key;

(c) a data paralleling circuit means, connected to said note selection circuit to receive said selected wave data signal, for paralleling the wave data signal thus selected and for setting the bit position thereof according to octave ranges, thereby to output a parallel signal having a predetermied number of bits; and (d) at least one waveform memory in which waveform sample point amplitudes are stored in addresses thereof, and readout means, cooperating with said memory and said data paralleling circuit means, for reading out from said memory the stored contents thereof utilizing the parallel signal outputted by said data paralleling circuit means as an address signal.

14. An electronic musical instrument as claimed in claim 13, in which said data paralleling circuit means comprises:

(a) a shift register for receiving and successively shifting said wave data signal, said shift register having a plurality of stages;

(b) a detection circuit, cooperating with said shift register, for detecting the fact that said data bits have been inputted into certain predetermined stages of said shift registers;

(c) a latch circuit, having a set of positions and cooperating with said shift register and said detection circuit, for latching, in a parallel mode the plurality of data bits from the stages of said shift register in response to the detection operation of said detection circuit; and (d) a circuit, cooperating with said latch circuit, for setting into which positions of said latch circuit said data bits are to be latched, according to the octave range specified by said depressed key.

15. An electronic musical instrument as claimed in claim 14, in which said multiplexed octavely-related wave data generator means are ones in which a timing signal, representative of the timing of presence of each set of wave data bits, is delivered out prior to said set, and said detection circuit is one in which the detection operation thereof is carried out by utilization of said timing signal.

16. An electronic musical instrument as claimed in claim 13, in which said waveform memory is one which stores a half period waveform of a symmetrical waveform, and said data paralleling circuit means is one in which said wave data signal is converted into a Gray code thereby to output a Gray-coded parallel signal, and in which a symmetrical waveform is obtained by reading out said half period waveform stored in said waveform memory in a reciprocating fashion utilizing said Gray-coded parallel signal as an address signal.

17. An electronic musical instrument according to claim 16 wherein said Gray code conversion is accomplished by a circuit which exclusively-ORs together adjacent bits of said wave data signal.

* * * * *